US008667819B2

(12) United States Patent
Ramsauer

(10) Patent No.: US 8,667,819 B2
(45) **Date of Patent: *Mar. 11, 2014**

(54) LOCK TO BE MOUNTED IN OPENINGS IN A THIN WALL

(76) Inventor: Dieter Ramsauer, Schwelm (DE)

( * ) Notice: Subject to any disclaimer, the term of this patent is extended or adjusted under 35 U.S.C. 154(b) by 652 days.

This patent is subject to a terminal disclaimer.

(21) Appl. No.: 10/590,638

(22) PCT Filed: Feb. 28, 2005

(86) PCT No.: PCT/EP2005/002083

§ 371 (c)(1),
(2), (4) Date: Aug. 23, 2006

(87) PCT Pub. No.: WO2005/083209

PCT Pub. Date: Sep. 9, 2005

(65) Prior Publication Data

US 2008/0060401 A1 Mar. 13, 2008

(30) Foreign Application Priority Data

Feb. 27, 2004 (DE) ..... 20 2004 003 238 U

(51) Int. Cl.
*E05B 13/10* (2006.01)

(52) U.S. Cl.
USPC ..... 70/208

(58) Field of Classification Search
USPC ..... 70/208, 370, 449
See application file for complete search history.

(56) References Cited

U.S. PATENT DOCUMENTS

| | | | | |
|---|---|---|---|---|
| 1,426,239 | A * | 8/1922 | Witzberger | 411/385 |
| 5,251,467 | A | 10/1993 | Anderson | |
| 5,435,159 | A * | 7/1995 | Ramsauer | 70/370 |
| 6,145,352 | A * | 11/2000 | Vickers et al. | 70/208 |
| 6,508,092 | B1 * | 1/2003 | Laabs et al. | 70/370 |
| 6,553,796 | B2 * | 4/2003 | Finch | 70/208 |

FOREIGN PATENT DOCUMENTS

| | | |
|---|---|---|
| BE | 883121 | 11/1980 |
| DE | 342387 | 10/1921 |
| DE | 31 47 854 | 9/1982 |
| EP | 0 258 491 | 3/1988 |

* cited by examiner

*Primary Examiner* — Kristina Fulton
(74) *Attorney, Agent, or Firm* — Frommer Lawrence & Haug LLP

(57) ABSTRACT

The description relates to a latch such as a socket wrench latch, swivel lever latch (10), folding lever latch, sash latch for mounting in openings (12, 14) in a thin wall (16, 50), comprising a head part (24) which is to be arranged on one, outer side (18) of the thin wall (16) and which overlaps the outer rim (20) of the opening, and a body part (26, 28, 30, 32) which proceeds from the head part (24) and projects through the opening in the mounted position, and holding elements (36) which project from the body part (26, 28, 30, 32) and are flexible in direction of its outer surface, the free end of these holding elements (36) being provided with an inclined surface (38) for supporting the body part without play on the rim or edge (40) of the opening of the other, inner side (42) of the thin wall (16), characterized in that the body part (26, 28, 30, 32) and holding element (36) are two separate parts.

6 Claims, 32 Drawing Sheets

LOCK TO BE MOUNTED IN OPENINGS IN A THIN WALL

CROSS-REFERENCE TO RELATED APPLICATIONS

This application claims priority of International Application No. PCT/EP2005/002083, filed Feb. 28, 2005 and German Application No. 20 2004 003 238.4, filed Feb. 27, 2004, the complete disclosures of which are hereby incorporated by reference.

BACKGROUND OF THE INVENTION a) Field of the Invention

The invention is directed to a latch, such as a socket wrench latch, swivel lever latch, folding lever latch, sash latch, for mounting in openings in a thin wall, comprising a head part which is to be arranged on one, outer side of the thin wall and which overlaps the outer rim of the opening, and a body part which proceeds from the head part and projects through the opening in the mounted position, and holding elements which project from the body part and are flexible in direction of the outer surface of the body part, the free end of these holding elements being provided with an inclined surface for supporting the body part without play on the rim of the opening of the other, inner side of the thin wall.

b) Description of the Related Art

U.S. Pat. No. 5,435,159 discloses a snap fastening for quick mounting of a lock housing which can be arranged, for example, in a round opening in a thin wall. The housing which is intended for a sash latch comprises a head part, namely, a flange, which is to be arranged on one, outer side of the thin wall and which overlaps the outer rim of the opening, a body part which projects through the opening in the mounted position proceeds from this head part, and tongue elements which are flexible in the direction of the outer surface of the body part project from the body part and have an inclined surface at their free ends for supporting the body part without play on the rim of the opening of the other, inner side of the thin wall. The holding force of the holding elements or tongue elements which are formed integral with the body part depends upon their spring tension, which depends upon the plastic material that is used, and therefore this holding force cannot be made as high as might be desired.

EP 0258491 A1 discloses a similar construction by which a lock cylinder can be fastened in thin-walled doors, drawers or the like by means of a plastic housing which receives the lock cylinder and which forms holding tongues. By means of inclined surfaces at the ends of the tongues it is possible to adapt in a desirable manner to commonly occurring variations of the structural component parts to be locked. It is also stated in column 9 of the reference that the springing tongues can no longer deflect inward after the lock cylinder is mounted in the housing. This has the disadvantage that a very particular design, namely, a round housing with a lock cylinder inserted therein, must be provided in order to allow the tongues to be locked in this way after mounting.

OBJECT AND SUMMARY OF THE INVENTION

The object of the invention is to provide a further development of the known arrangement in which these disadvantages do not occur and which makes possible simple mounting without loose mounting parts such as nuts or screws, cannot be disassembled without a special tool, withstands vibrations, and is very sturdy.

The object, in particularly to increase sturdiness, is met in that the body part and holding element are two separate parts.

This makes it possible to provide a snap fastening for quick mounting of latches such as, e.g., socket wrench latches, swivel lever latches, folding lever latches, sash latches, cylinder housings and the like in openings in a thin wall for latches of different shapes, that is, not only for round lock cylinders, whose holding force does not depend on the plastic material used for the tongues, can accordingly have any desired magnitude in theory, and can be adapted to the task at hand.

In the simplest embodiment form, the body part and head part are injection molded in one piece, for example, from plastic. However, it is also possible to construct the body part and head part as two parts which are screwed, welded, glued or even snapped together.

According to a further development, supporting elements are provided in the body part and are held or carried by the latter for supporting the holding elements after the latch is mounted in the thin wall.

According to another further development of the invention, two holding elements which are arranged diametrically opposite from one another are provided and are supported by spring arrangements such as spiral springs and/or wedge devices such as conical screws. Since the spring arrangements can be provided with spring force that, in itself, can be freely selected, the locking force can be adapted to the task at hand and does not depend upon the plastic material.

In the prior art, the locking force depends extensively upon the shape of the fitting and upon the material characteristics of the plastic that is used.

According to a further development of the invention, the holding elements are levers which are arranged at a distance from the thin wall so as to be rotatable around an axis parallel to the plane of the thin wall such as the door leaf plane. Alternatively, the holding elements are levers which are arranged at a distance from the door leaf plane so as to be swivelable around an axis perpendicular to the door leaf plane.

According to another alternative, the holding elements are slides which are arranged so as to be displaceable in a cylinder that lies parallel to the door leaf plane and is rectangular in cross section. These slides are held against the force of a pressure spring by a locking hook arrangement arranged between the slides.

When the two diametrically oppositely arranged holding elements are loaded to different extents, such as when a sash is used, it is advantageous when the locking part upon which the smaller load is exerted is made of flexible plastic such as polyamide and the other locking part upon which the greater load is exerted is made of metal.

Another embodiment form is characterized in that the holding elements are slides comprising a rigid material such as metal which are arranged so as to be displaceable in a cylinder which is parallel to the door leaf plane and is rectangular in cross section and are held against the force of a pressure spring by a pin arrangement that is arranged between the slides.

The pin arrangement can also comprise screws that are screwed into the head part, and it is possible, according to another embodiment form, for the screws to fasten the body part to the head part.

The cylinder can have a partial dividing wall or undercut or opening edge at which slides are supported axially by a shoulder or hook.

The body part can have a slot for receiving a grounding spring.

Another embodiment form, in which the latch is a swivel lever latch or a folding lever latch for fastening in an elongated opening or in two shorter rectangular openings, wherein one opening receives the lever bearing, e.g., the drive shaft, and the other opening receives a lever stop, is characterized in that at least one of the openings also serves to receive at least one holding element according to one of the preceding embodiment forms.

In particular, the swivel lever latch can have a dish or trough for receiving the actuating lever in a lockable manner, and, according to the invention, the trough forms the head part of one or two holding elements in the area of the lever bearing such as a drive shaft.

The swivel lever latch can have a trough for receiving the actuating lever in a lockable manner and is characterized in that the trough forms the surface behind which the cam of a lever stop engages on the one hand and forms the head part of a holding element in the area of the lever stop on the other hand.

When a trough is used, it is advantageous when the holding elements are formed by slides which are held so as to be displaceable and whose movement axis lies perpendicular to the longitudinal extension of the trough.

The holding elements can be formed by a leaf spring in a simplified manner. In this connection, it is possible for the leaf spring to be held in a slot formed by the body part. Alternatively, the leaf spring can also be supported by a screw that is held in the body part. In embodiment forms of this type, it is advantageous for purposes of grounding when the leaf spring has a cutting edge at its free end to be placed on the thin wall, which comprises metal in this case, between a ground connection.

BRIEF DESCRIPTION OF THE DRAWINGS

The invention will be explained more fully in the following with reference to embodiment examples shown in the drawings.

FIGS. 49A to 49D show different views of the lock case according to FIG. 46 which is installed in a wall and with associated cover for the second opening that can be snapped in;

FIGS. 84A to 84C show three different views of an embodiment form in which a guide channel is formed through a top that is screwed on;

FIGS. 90A to 901 show different views of a pull-type sash lock having a fastening element according to the invention;

DESCRIPTION OF THE PREFERRED EMBODIMENTS

Figure 1:
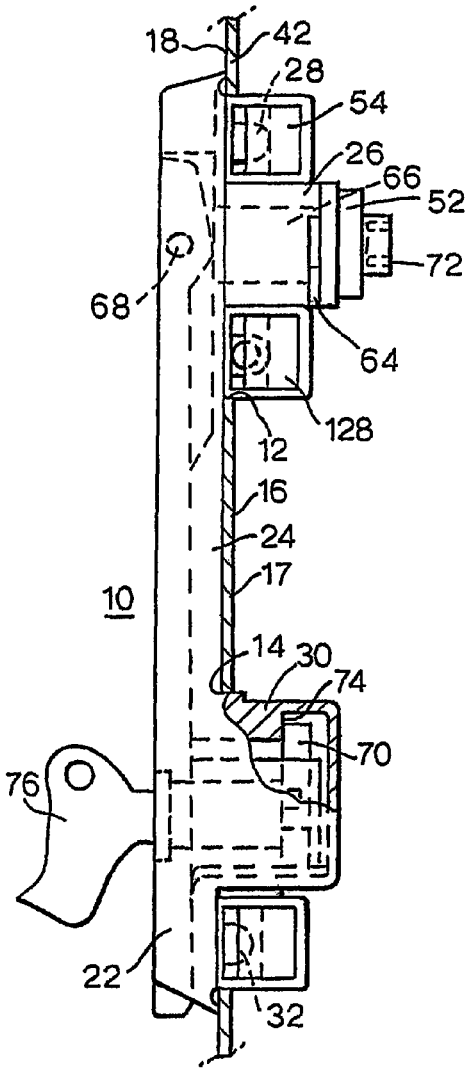
FIG. 1 shows an axial section through a trough for a swivel lever latch in which the snap fastening according to the invention is used.
Figure 27:
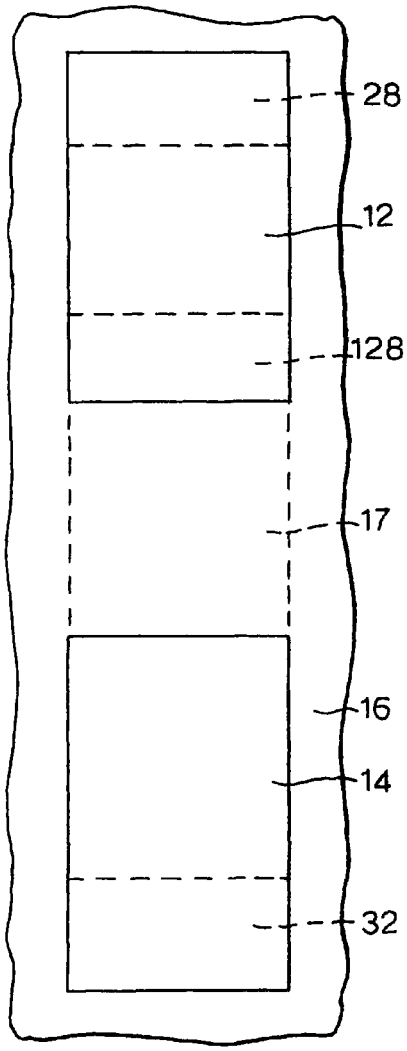
FIG. 27 shows two openings in which a swivel lever latch according to FIGS. 1, 2 with snap devices can be installed.

FIG. 1 shows a longitudinal section through a swivel lever latch 10 as an example of a fastening of a latch according to the invention. The swivel lever latch 10 is arranged in two rectangular openings 12, 14 of a thin wall 16 which, in the present instance, is part of a sheet-metal cabinet door leaf, see also FIG. 27. When the center web 17 is omitted, a long rectangular opening results. This would also be suitable.

In the area of each opening 12 and 14, the swivel lever latch comprises a head part, in the present instance a trough 24, that receives the swivel lever 22. This head part is to be arranged on one, outer side 18 of the thin wall 16 and overlaps the outer rim 20 of the opening 12 and 14, respectively. A body part 26 which projects through the opening 12 and 14, respectively, in the mounted position proceeds from this head part or trough 24. As is shown in FIG. 3, tongue elements or holding elements 36 which are flexible in direction of the outer surface 34 project from this body part 26, their free ends having an inclined surface 38 for supporting the body part 26, 28 on the rim or edge 40 of the opening 12 and 14, respectively, of the other, inner side 42 of the thin wall 16 without play.

The body parts 28, 32 proceeding from the head part, that is, from the trough 24 in the present instance, have holding elements 36 which are displaceable against any force of a spring 44 in the body part 26. These holding elements are held by locking elements 46, 48 after being mounted in the body part. FIG. 1B shows that the locking elements are hooks which hook in one another. The material of these hooks advisably comprises polyamide, that is, they are flexible enough that when the holding elements 36 move linearly in the body part 26, 28 they can deflect to a sufficient degree and move past one another and spring back so as to hook into one another so as to be fastened on the top and bottom with reference to FIG. 2, so that they remain in the position shown in FIG. 2, and the body parts 32, 28, 128 proceeding from the trough 24 are accordingly securely held in the associated rectangular opening. This locking can be so designed by means of spring arrangements 44 of corresponding force that the holding elements or snap elements 36 do not move back against the force of the spring 44 under normal circumstances and operating conditions.

When the latch, as in the present case, comprises a sash tongue 52 located behind a door frame bevel 50, the two holding elements 36, 136 located diametrically opposite one another are loaded to different degrees. The pressure exerted on the tongue 52 in its position in which it engages from behind is absorbed for the most part by the rim 20 of the sash trough located opposite the holding element 36, while a smaller load is exerted on the holding element 36, whereas on the opposite side the reverse is true because the greatest load is exerted on this holding element 136. In order to take this varying load into account, it can be useful when the snap element 136 bearing the greater load is made from metal and not, for example, from plastic. When the holding element 36 on which the smaller load is exerted is made of a plastic such as polyamide, this holding element remains flexible and is therefore able to move back in a springing manner when the two holding elements 36, 136 move in and lock together.

Figure 3:
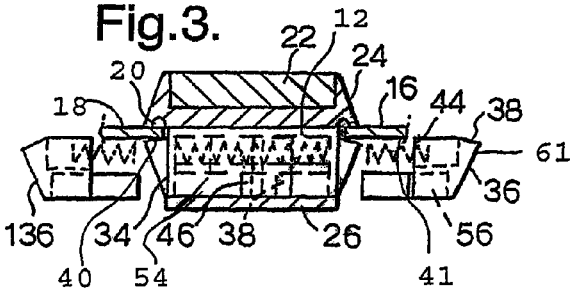
FIG. 3 shows a cross section through the snap fastening for the trough according to FIGS. 1 and 2.
Figure 4:
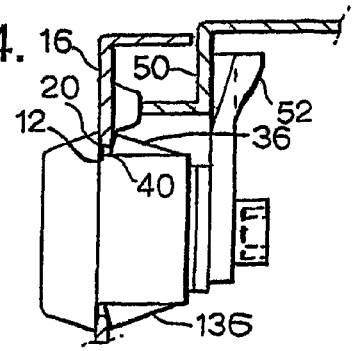
FIG. 4 shows a top view of the trough according to FIGS. 1 and 2.

In the embodiment form according to FIG. 3, the two locking parts 36, 136 are slides 56 which are arranged so as to be displaceable parallel to the door leaf plane in a cylinder 54 which is rectangular in cross section, these slides 56 being held against the force of two pressure springs 44 supported at a central wall 58 by a locking hook arrangement 46, 38 which is arranged between these slides 56. In the embodiment form according to FIG. 5B, the arrangement is designed in such a way that the holding elements 236 are levers 236 which are arranged at a distance A from the door leaf plane 16 so as to be rotatable around an axis 60 parallel to the door leaf plane.

The two levers 236 are each pressed outward at their inner end by a shared, strong pressure spring 244.

By means of the snap devices, it is possible to mount the lever latch in the thin wall simply by pressing it into two suitably shaped rectangular openings in that edges of the two openings 14, 12 lying in direction of the trough axis 62 press the contacting inclined surfaces of the holding elements 36, 136, 236 inward against the force of the springs 44, 144, 244 when pushing in and allow them to spring back when the inclined surface 38 is reached, thereby securing the trough in the door leaf.

With regard to the construction of the swivel lever latch, the tongue may be provided with a rotatable cross stop, indicated at 64, in order to convert the swivel lever to right-handed operation or left-handed operation. A bar lock body with pinion and bar stop which is connected to the trough can also be mounted and snapped in, particularly when the center web 17 between the two openings 12, 14 in the thin wall 16 is omitted resulting in an elongated opening comprising openings 12, 14 (see FIG. 27).

Figure 2:
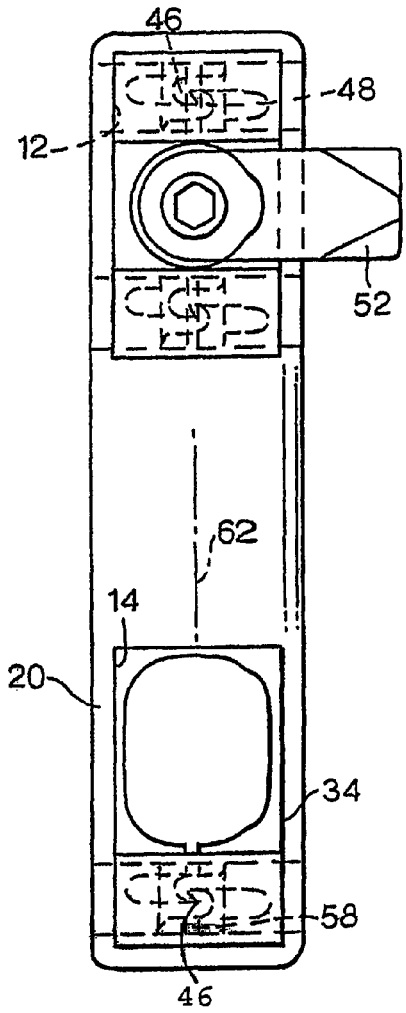
FIG. 2 shows a rear view through the trough which is fastened to the snap fastening according to the invention.

As can be seen from FIGS. 1 and 2, the top body part 26 projecting from the trough 14 serves as a bearing for a drive shaft 66, the hand lever 22 being articulated at the end of the drive shaft 66 located outside of the door leaf so as to be swivelable around an axis 68 perpendicular to the door leaf plane, while the inner end of the shaft 66 terminates by a square, a tongue 52 having a square opening being mounted on this inner end and held by means of a fastening screw 72.

A holding element 28, 128 adjoins the bearing block for the shaft 68 at the top and/or at the bottom. The holding elements and the bearing block together make up the dimensions for the passage through the rectangular opening in the door leaf.

At the lower end of the trough, a receiving area 30 for a cylinder lock locking part proceeding from the hand lever 22 is provided with an eccentrically moving tongue or cam 70 which can be locked behind an offset surface 74 by actuating a cylinder key 76 in the folded in position.

Figure 5A:
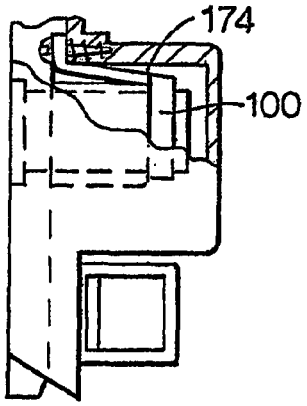
FIG. 5A is a partial view of an embodiment form with a different lever lock.
Figure 5B:
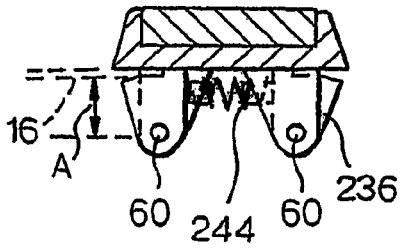
FIG. 5B is a view similar to that in FIG. 3 showing an alternative embodiment form of the snap-like holding element.

Alternatively, as is shown in FIG. 5A, a spring engaging element 174 is provided so that a folding in movement and locking can be carried out when the key is removed, and the rotating tongue 170 could also be mountable on the cylinder roller so as to be rigid against rotation by means of the snap devices.

Figure 6A:
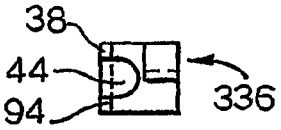
FIGS. 6A, 6B and 6C show different views of the holding elements used in the embodiment form according to FIG. 5A.
Figure 6B:
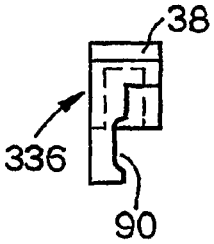
Figure 6C:
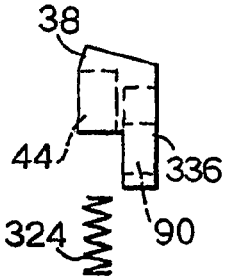
Figure 6D:
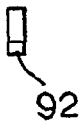
FIG. 6D shows the holding pin which is used in the holding elements according to FIGS. 6A to 6C.
Figure 7A:
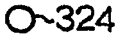
FIGS. 7A and 7B show two different views of the springs, two of these springs being used in the snap device.
Figure 7B:
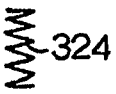
Figure 8A:
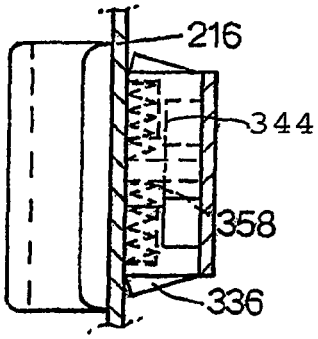
FIGS. 8A and 8B show two different views of the snap device that can be used in the hinge according to FIG. 1.
Figure 8B:
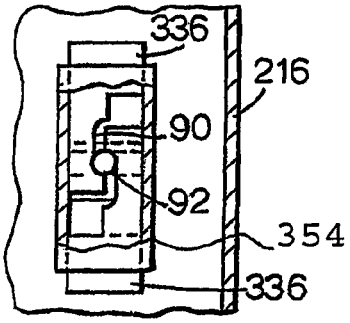

A design such as was already described in connection with the swivel lever latch or such as that shown in the embodiment form according to FIGS. 6A to 6C can also be selected for fastening. In this case, a pin according to FIG. 6D is used for locking instead of the hooks. Two structural component parts made of metal according to FIGS. 6A to 6C are inserted into a rectangular guide channel according to FIG. 8B and are held in the inserted position in such a way by means of a pin, according to FIG. 6D, which is screwed in from the outside, that these structural component parts can move relative to one another by a short distance but cannot fall out. This is achieved by means of the offset 90, which provides a path along which one half of the width of the pin 92 can run, and by the spiral spring 344 which is supported in an opening 94 of the part 336 on one side and on an intermediate wall 358 on the other side. The part 336 is shaped symmetrically such that it permits the mounting possibility according to FIGS. 8A and 8B.

Figure 13:
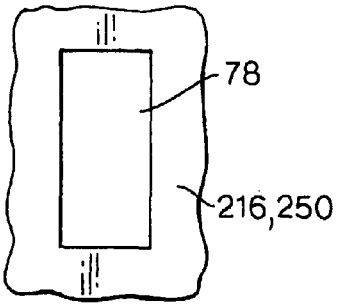
FIG. 13 shows an opening in which a snap device can be installed, e.g., according to FIGS. 14A and 14B.

The rectangular opening required in the door frame 250 and in the door leaf 216 for this purpose is shown, for example, in FIG. 13 by reference number 78.

Figure 9A:
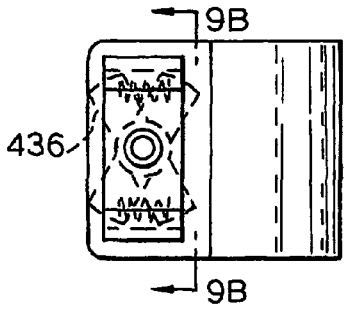
FIGS. 9A, 9B and 9C show three different views of an alternative embodiment form of a fastening device which can be partly snapped in and partly welded, shown in combination with a hinge for purposes of illustration.
Figure 9B:
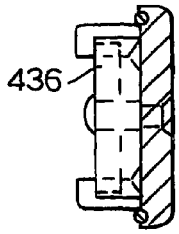
Figure 9C:
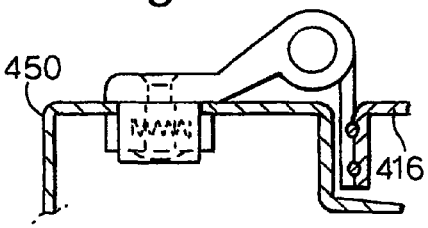

FIGS. 9A, 9B and 9C show an embodiment form, e.g., for a hinge, in which one hinge part is welded to the door leaf 416, while the other hinge part is held at the door frame 450 with another embodiment form of the snap fastening according to the invention. The latter comprises lever devices 436 which are arranged at a distance from the door leaf plane so as to be rotatable around an axis perpendicular to the door leaf plane and which are pressed outward by spring devices and then engage rim areas of a rectangular opening arranged in the door leaf 450.

Figure 10A:
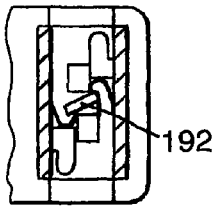
FIGS. 10A and 10B show different views of another embodiment form.
Figure 10B:
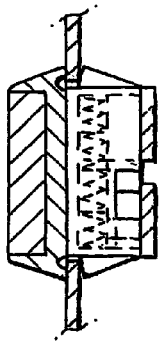
Figure 11:
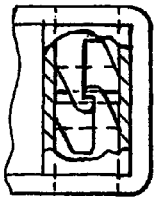
FIG. 11 shows another embodiment form.

FIGS. 10A and 10B show an embodiment form in which the two holding elements which can be pressed apart by spring devices are held relative to one another by hooks between which a diagonally positioned wedge 192 is arranged. FIG. 11 shows a similar construction.

Figure 12:
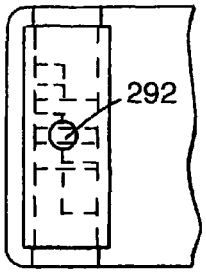
FIG. 12 shows still another embodiment form.

A round pin 294 by which two parts comprising a hard material such as metal which are displaceable relative to one another are held in position is provided in FIG. 12.

Figure 14A:
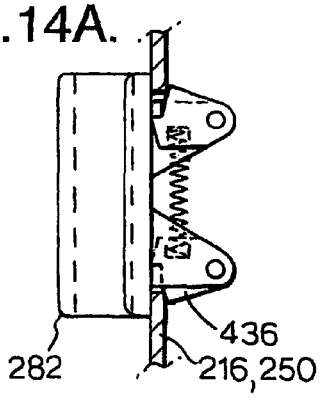
FIGS. 14A and 14B are two views of an alternative hinge.
Figure 14B:
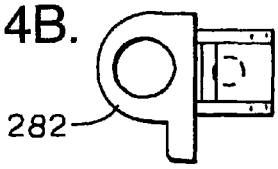

FIG. 13 shows a rectangular opening 78 which is suitable for locking in the construction described in this example. A hinge element, for example, as is shown in a side view and a front view in FIGS. 14A and 14B, could be snapped into this rectangular opening 78. In other respects, the construction is similar to that shown in FIG. 5B, although the present instance is directed to a (top) hinge part 282.

Figure 15A:
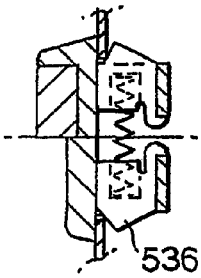
FIG. 15A shows a cross section through a fastening for a swivel lever latch in the upper part of the drawing and for another latch in the bottom part of the drawing.
Figure 15B:
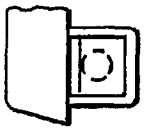
FIG. 15B is a top view of the arrangement according to FIG. 15A.
Figure 16:
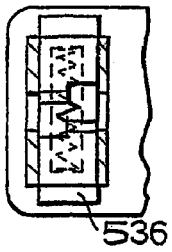
FIG. 16 is a view from the right-hand side of the object shown in FIG. 15A in the snapped in state.
Figure 17:
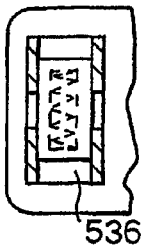
FIG. 17 shows the arrangement according to FIG. 16, but in the pushed back snap-in position.

FIGS. 15A, 15B, 16 and 17 show a fastening in which a swivel lever, in the top half of FIG. 15A, and a hinge lever, in the bottom half of FIG. 15A, can be fastened in a rectangular opening of a thin wall. In this instance, an individual spring is provided which presses the two holding elements 536 out of the pressed back snap-in position, shown in FIG. 17, into the snapped in position according to FIG. 16 when the structural component part or fitting is pressed into the installation opening.

Figure 18A:
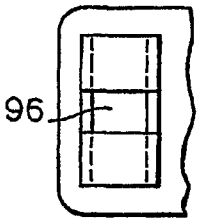
FIGS. 18A and 18B show two views of the individual part.
Figure 18B:
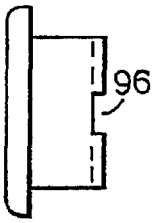
Figure 19A:
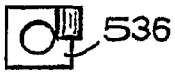
FIGS. 19A and 19B show two views of the holding element.
Figure 19B:
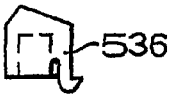
Figure 20:
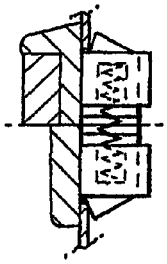
FIG. 20 shows another embodiment form in a view similar to that shown in FIG. 15A.
Figure 21:
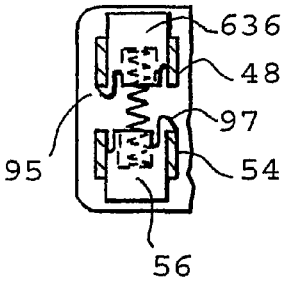
FIG. 21 shows the embodiment form according to FIG. 20 in the snapped-in state from the right-hand side.
Figure 22:
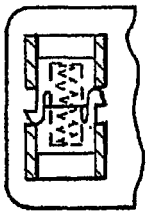
FIG. 22 shows the arrangement according to FIG. 21, but in the pushed back snap-in position.
Figure 23A:
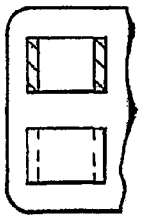
FIGS. 23A and 23B show views of the arrangement according to FIG. 20 similar to those in FIGS. 18A, 18B.
Figure 23B:
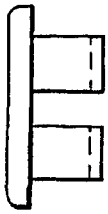
Figure 24A:
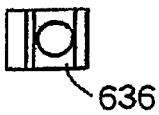
FIGS. 24A and 24B show two views of the associated holding element.
Figure 24B:
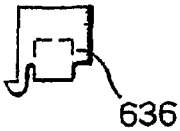

In FIGS. 19A and 19B, the two holding elements 536 are shown in detail in two different views. FIGS. 18A and 18B show the associated individual part as a hinge tab. It is significant that the hook of the holding element 536 is supported at a wall opening 96 in this case. Instead of the solution having the center web and the two springs which was described above, wherein the holding elements are held against one another, the present solution has one spring and an opening at the front in which the snap elements 636 are held by hooks in the assembled delivered state. In the embodiment form shown in FIGS. 20, 21, 22, 23A, 23B, 24A, 24B, which is similar to the embodiment form according to FIGS. 15 to 19, a lateral opening is provided in the holding channel or guide channel instead of a front opening. The advantage in both cases consists in that only one spring is required.

Figure 26B:
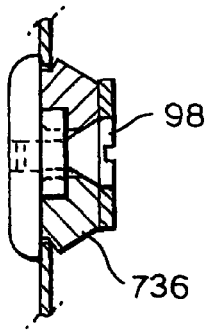
FIGS. 26A and 26B show two views of an embodiment form with a conical screw.
Figure 26A:
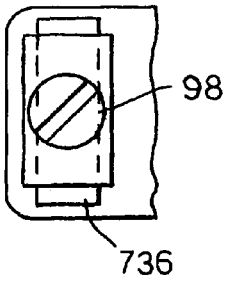
Figure 28:
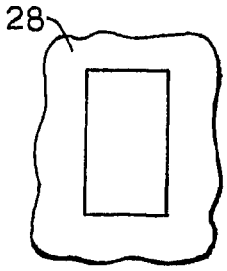
FIG. 28 shows an installation opening in a thin wall which fits the snap devices according to FIGS. 17 to 26.

FIGS. 26A and 26B show two different views of an embodiment form in which two holding elements 736 are pressed apart by the conical screw 98 resulting in a particularly great holding force. In this case, the screw head lies on the inside, and blind fastening is therefore impossible. However, a conical nut could also be tightened by a screw from the outside, which would have the same effect and would, moreover, allow for blind mounting.

Figure 25:
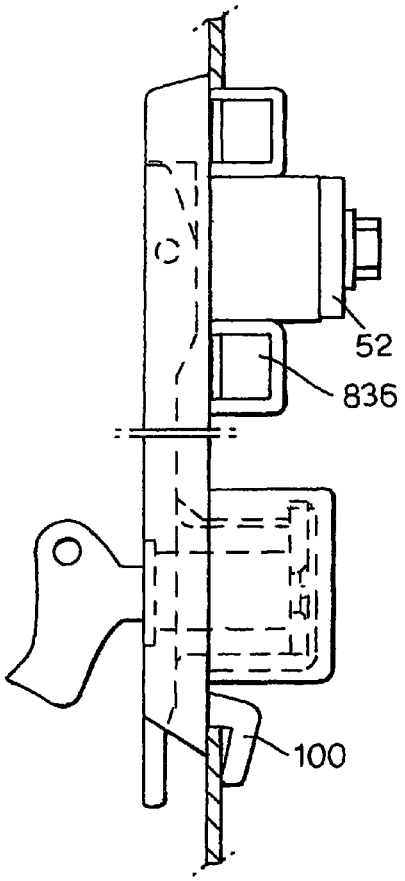
FIG. 25 shows an alternative embodiment form for a swivel lever latch in which only the top part is fastened with the snap device according to the invention, while the bottom part is fastened with a hook.

FIG. 25 shows a swivel lever with a hook fastening, known per se, which is arranged at the bottom end. However, holding elements 836, according to the invention, are provided at the top end. Since only small forces act at the bottom end, referring to FIG. 25, a hook fastening by means of hooks 100 is sufficient, whereas in the tongue area 52, where the closing forces and the rotation of the hand lever bring about greater forces, the arrangement 836 according to the invention is provided in any of the above-mentioned embodiment forms, particularly the embodiment form 736 with conical screw.

In this way, the optimal type of fastening can be selected depending on the load.

Figure 29:
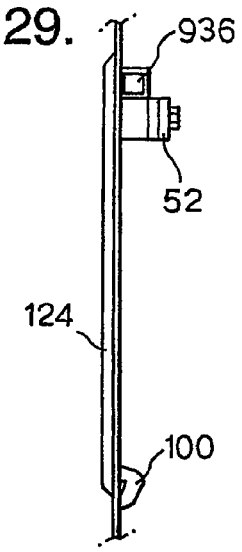
FIG. 29 is a side view of an embodiment form showing an escutcheon or key plate with pin actuation which can be fastened by means of a hook instead of a swivel lever latch according to FIG. 25.
Figure 30:
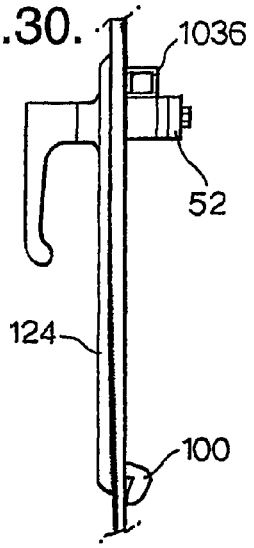
FIG. 30 is a view similar to that in FIG. 29 showing an arrangement with a handle lever actuation which is fastened by only one snap element at one end and by a hook at the other end.

While a top end is secured by two holding elements 836 in the swivel lever latch according to FIG. 25, only one holding element 936, 1036 of this kind is provided in the embodiment forms according to FIG. 29 and FIG. 30.

In FIG. 25, a hook 100 is located at the other end of the escutcheon or head part 24. The embodiment form according to FIG. 29 shows a socket wrench latch, and the embodiment form according to FIG. 30 shows a lever latch.

Figure 31A:
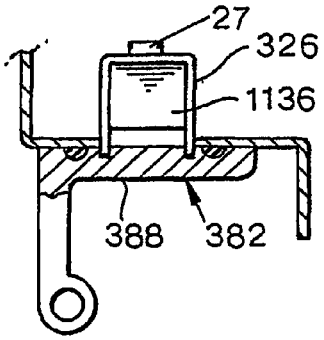
FIGS. 31A to 31C show different views of a fastening according to the invention, wherein the head part and body part are two pieces and are held together by screws, shown with reference to a hinge.

FIG. 31A shows a sectional top view of a fitting part, in this case a hinge part 382, in which the body part 326 is fastened by means of head screws 27 to the tab 388 forming the head part. At the same time, these screws 27 define the lift of the fastening elements 1136 (see elongated hole 29) within which the screw cross section 27 can move.

Figure 31B:
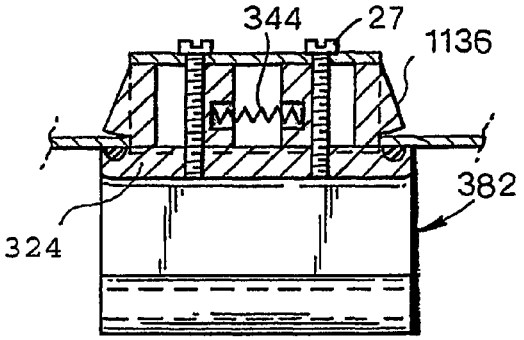
Figure 31C:
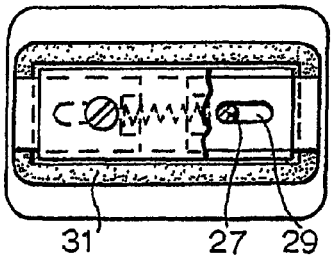

As follows from FIG. 31B or 31C, which show a bottom view in axial section, the elements 1136 move inward in the channel against the force of the spring 344 when inserting insofar as permitted by the elongated hole extension 29 and then jump again into the locking position shown in FIG. 31B. This separation of the head part and body part of the fastening system is advantageous, for example, when grooves 31 are to be provided for sealing rings 33. As a result of this, the tools for the injection molding process can be difficult to manage when it is desirable to manufacture a one-piece construction.

Figure 32A:
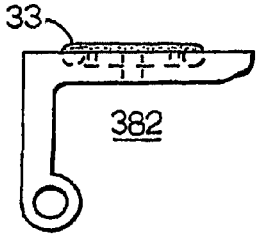
FIGS. 32A to 32C show three different views of the head part.
Figure 32B:
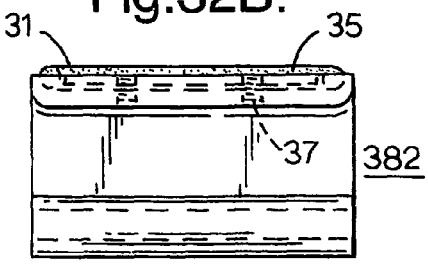
Figure 32C:
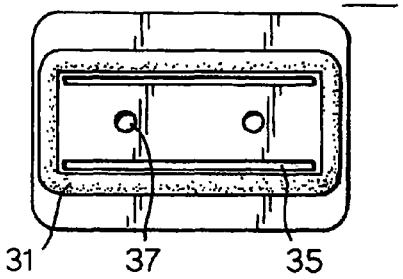
Figure 33A:
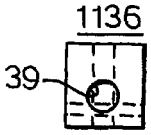
FIGS. 33A to 33C show three different views of the holding element used in this case.
Figure 33B:
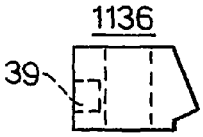
Figure 35A:
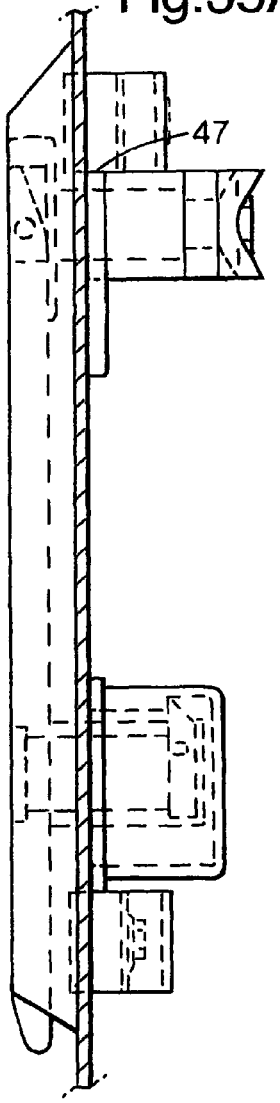
FIGS. 35A to 35D show four different views of a sash latch arrangement which is fastened at both ends by means of a holding element comprising a spring.
Figure 33C:
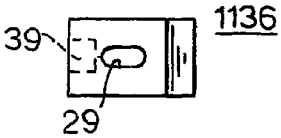
Figure 33D:
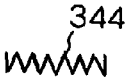
FIG. 33D shows a side view of the associated spiral pressure spring.

The hinge part 382 which is selected for purposes of illustration is shown in detail in FIGS. 32A, 32B and 32C in three different views. The drawings also show the groove 35 into which the free legs of the U-part 326 are inserted, as well as the threaded bore holes 37 into which the screws 27 can be screwed. The holding element which is used here is shown as an individual part in FIGS. 33A to 33C, including the receiving blind hole 39 for receiving a pressure spring 44.

Figure 34A:
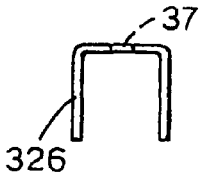
FIGS. 34A and 34B show two views of the U-shaped body part of the arrangement according to FIGS. 31A to 31C.
Figure 34B:
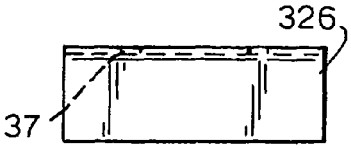
Figure 35B:
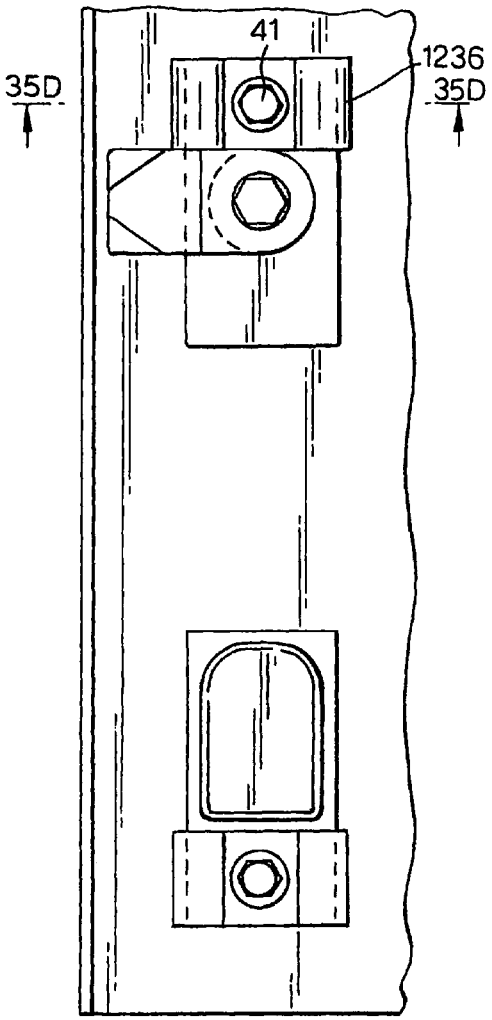
Figure 35C:
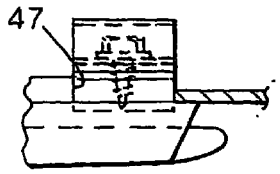
Figure 35D:
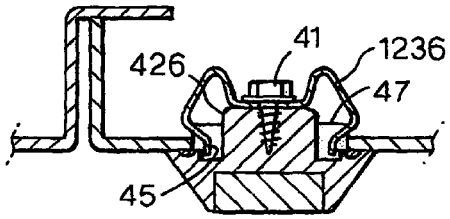
Figure 36A:
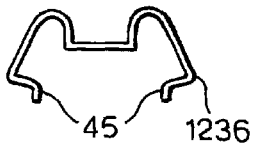
FIG. 36A is a side view of a spring that can be used in the embodiment form according to FIG. 35 having a cutting edge for a ground connection at the surface supported on the cabinet metal.
Figure 36B:
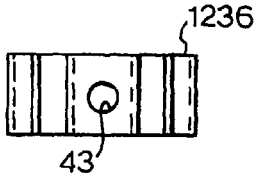
FIG. 36B is a top view according to FIG. 36A.
Figure 36C:
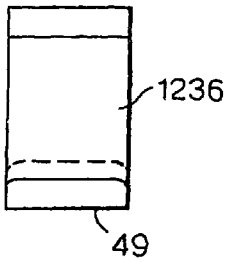
FIG. 36C is a view in direction of the arrow according to FIG. 36A.

The guide part for the holding elements 1136 is shown in a front view and in a side view in FIGS. 34A and 34B. In the latch arrangement shown in FIGS. 35A to D which comprises a swivel lever with a sash fastener that is driven by the latter, the trough for the swivel lever latch is held by snap elements which are arranged at both ends and formed by springs. These springs 1236 are shown in detail from the side and from the top in 36A and B and can be fastened in the trough by a screw 41. In the position and shaping shown in the figures, the spring 1236 is adapted to the outer contours of the holding element shown in the present figures and is designed with a spring force such as that delivered by the elements. The free ends of the spring 1236 have play on the inner side so that the ends of the spring can deflect back when pushed in.

A screw 41 inserted through a hole 443 in the spring 1236 is sufficient for carrying out the fastening because the free ends 45 of the spring are guided on a wall 47 formed by the trough. When the trough is made of an electrically conductive material such as metal, the spring can also serve to form a ground in that the end 45 of the spring vigorously contacts the edge of the opening and cuts through any residual oxidation and paint at that location when the spring releases after being pushed through. This results in an electrical conductive path from the trough to the door leaf by means of the spring 1236 and the fastening screw 41.

The ground contact can be further improved when the cut edge 49 is sharp.

Figure 37A:
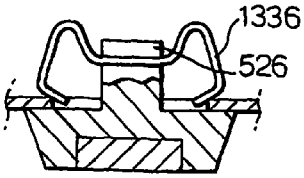
FIGS. 37A and 37B show two different views of a folding lever fastening with an insertable fastening spring.
Figure 37B:
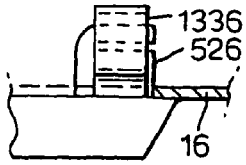
Figure 38:
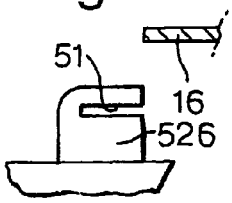
FIG. 38 is a partial view of the body part with the slot in which the spring is inserted.

FIGS. 37A, 37B and 38 also show an embodiment form which works with a spring. This spring 1336 is not screwed to the body part 526 of a fitting part, not relevant in the present context, as in FIG. 35D, but rather is inserted, namely into a lateral slot 51 which opens outward, that is, in direction of the opening edge of the thin wall 16 referring to FIG. 38, so that the spring 1336 cannot slip out in this direction when the fitting is mounted as is shown in FIG. 37B.

Figure 39A:
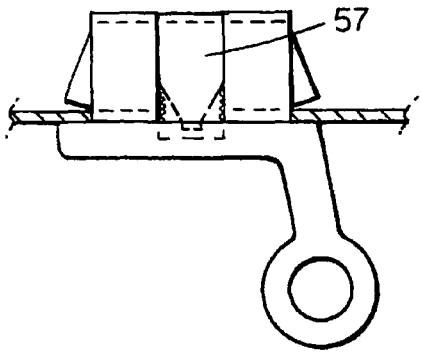
FIGS. 39A and 39B show a component part (in this case a hinge) which is fixed, according to the invention, at a door leaf and which also has a grounding spring arranged on it.
Figure 39B:
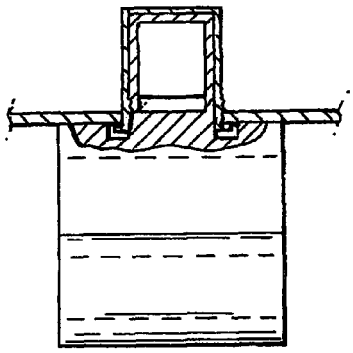
Figure 40A:
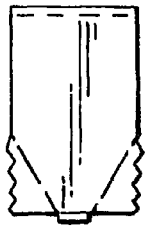
FIGS. 40A and 40B show two views of the associated grounding spring.
Figure 40B:
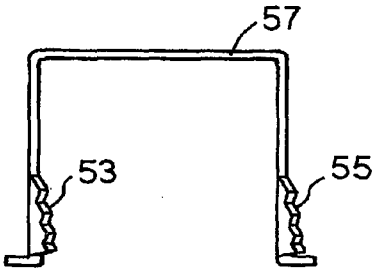
Figure 40C:
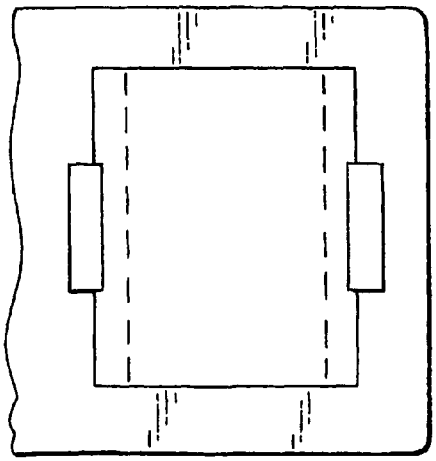
FIG. 40C shows a rear view of the door leaf with the installed component part with grounding spring.
Figure 41A:
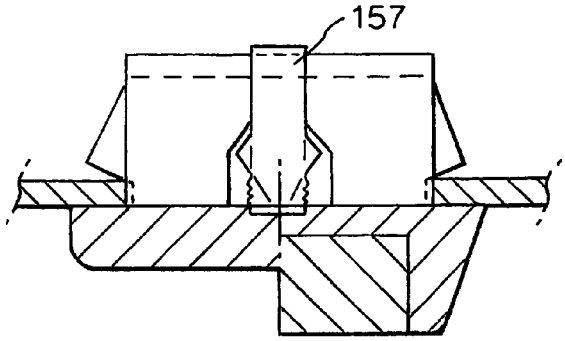
FIG. 41A shows two sectional views of a swivel lever trough and a hinge component part with fastening according to the invention without a grounding arrangement.
Figure 41B:
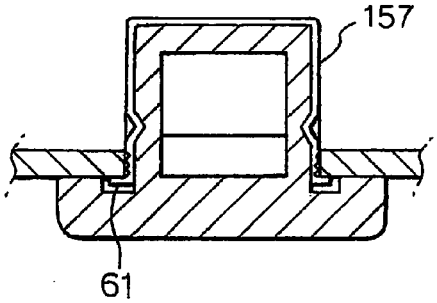
FIG. 41B shows another view of the arrangement according to FIG. 41A.
Figure 42A:
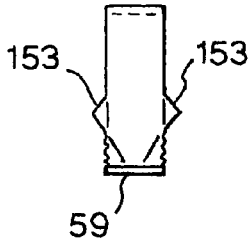
FIGS. 42A, 42B and 42C show different views of the associated grounding spring of FIGS. 41A and 41B.
Figure 42B:
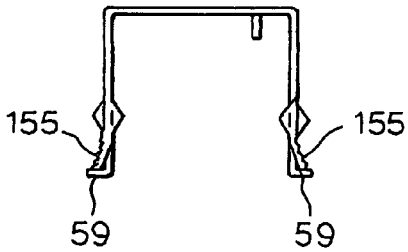
Figure 42C:
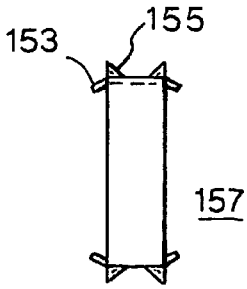

It can be seen from FIGS. 39A, 39B that a grounding spring for hinges or latches can be arranged in the area of the guide channel for the snap elements, which provides for metal contact on each side, between the sheet-metal door or door leaf or frame on one side and the hinge or latch cap on the other side. To this end, the U-shaped spring 57 which is shown from the side and from the front in FIGS. 40A and 40B is outfitted with a toothing 53 which is directed inward toward the body of the body part of the fastening element and with a toothing which faces outward at 55 to make contact with the opening of the thin wall as is also shown in FIG. 40C. A somewhat different construction for a grounding spring 157 is shown in FIGS. 41A, B and in FIGS. 42A, B and C. A toothing 155 which faces outward makes contact with the sheet metal in a manner similar to that in the embodiment form just described, while the sharp edge tooth 153 contacts the body of the guide channel for the holding elements and makes electrical contact therewith.

As is clearly shown in FIG. 41A, the grounding spring 157 is arranged centrally over the passage that is provided for the snap. The ends 59 of the spring are bent so as to remain in the grounding position. When passing through the opening, the upper tips 153 are each pressed flat and dig into the body part of the hinge body (FIG. 41A, left-hand side) or the trough of a swivel lever latch (FIG. 41A, right-hand side). However, this is only necessary when the parts are painted. As it continues to pass through, the bent out saw-teeth 155 scratch off the paint in the opening so that a good ground connection is made with the opening and the door leaf.

Figure 43A:
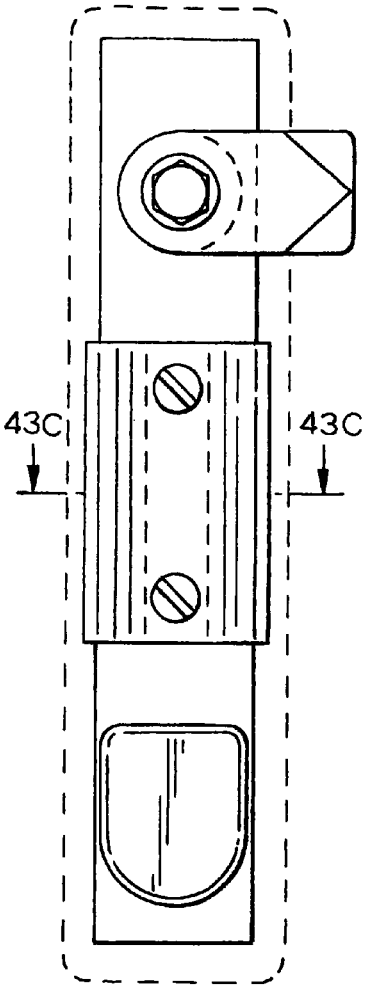
FIGS. 43A to 43C show three different views of a spring fastening for a swivel lever latch in which the spring fastening is arranged in the center, and the spring is fastened to the head part by screws.
Figure 43B:
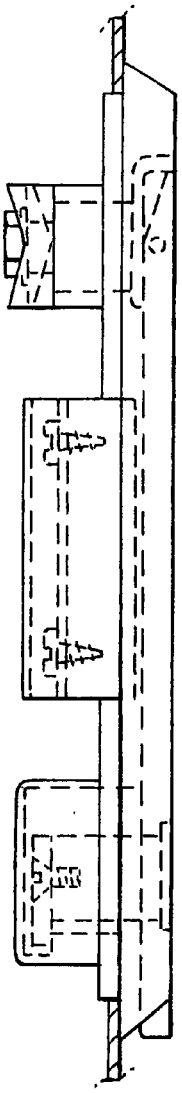
Figure 43D:
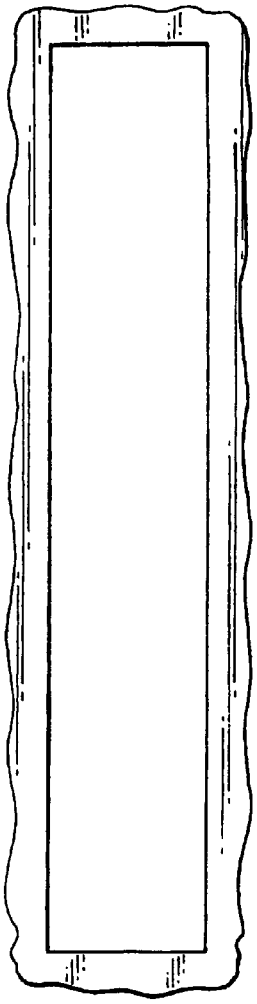
FIG. 43D shows the associated cutout in a thin wall.
Figure 43C:
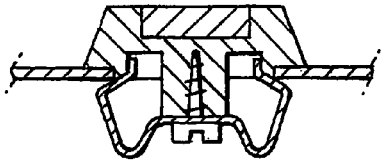
Figure 44A:
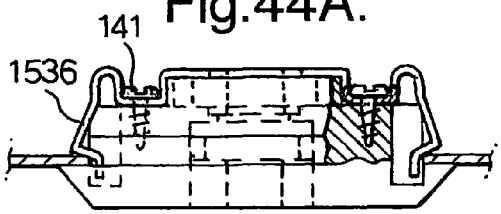
FIGS. 44A to 44C show three different views of a spring fastening for a lock case, wherein the spring, which is screwed in, serves as a bearing support for the pinion at the same time.
Figure 44B:
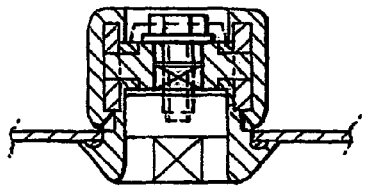
Figure 44C:
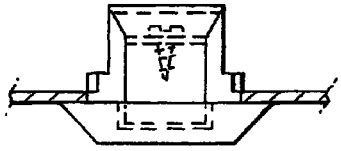

In the embodiment form shown in FIGS. 43A, 43B and 43C, the fitting shown here, a swivel lever latch, is fastened to the body part by two screws through a spring arrangement.

In this case, an elongated individual opening, as is shown in FIG. 43D, is needed instead of two openings lying one on top of the other.

The arrangement according to the invention is also suitable for a bar latch, particularly for the lock case of the latter with reference to FIGS. 44A, 44B, 44C and 44D. The figures show different views of a socket wrench latch which is held in the rectangular opening of a door leaf by springs 1536 which are screwed in 141. This spring serves as a bearing support for the pinion at the same time.

Figure 45A:
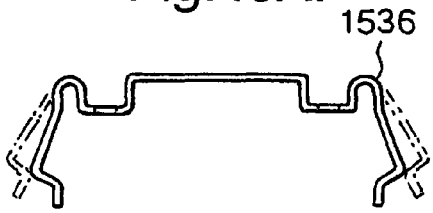
FIGS. 45A and 45B show two different views of the associated spring.
Figure 44D:
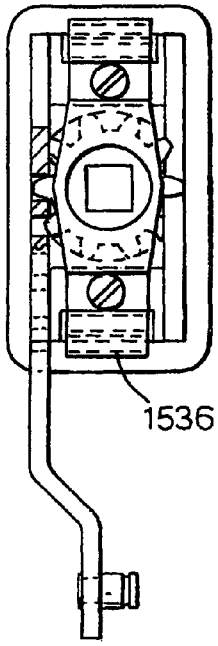
FIG. 44D shows a top view of the lock case according to FIG. 44A and a latch bar.
Figure 45B:
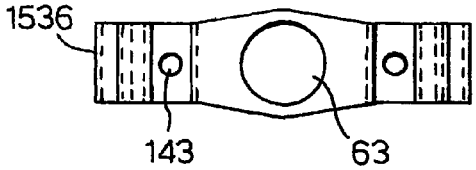
Figure 46A:
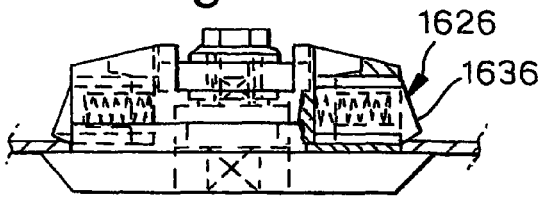
FIGS. 46A and 46B show two different sectional views of a socket wrench lock case with fastening, according to the invention, at the front sides of the lock case, with a cap supporting the follower and having snap arrangements which engage behind the bar.
Figure 46B:
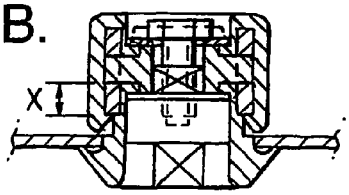
Figure 47A:
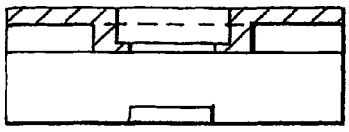
FIGS. 47A to 47C show two different detailed views of the lock case.
Figure 47B:
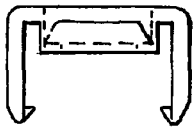
Figure 47C:
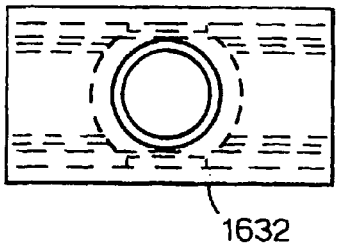
Figure 48A:
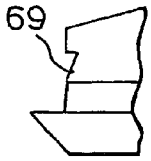
FIGS. 48A and 48B show an embodiment form with a cap which is held at the lock case.
Figure 48B:
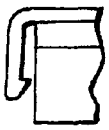
Figure 49A:
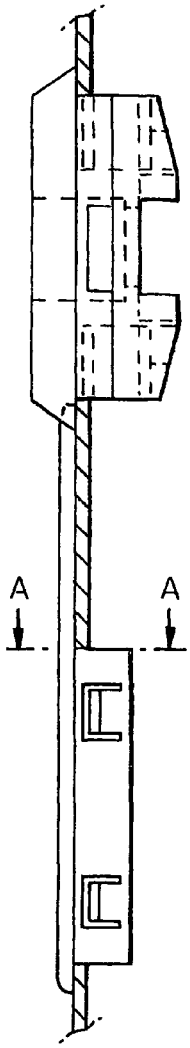
Figure 49B:
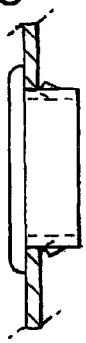
Figure 49C:
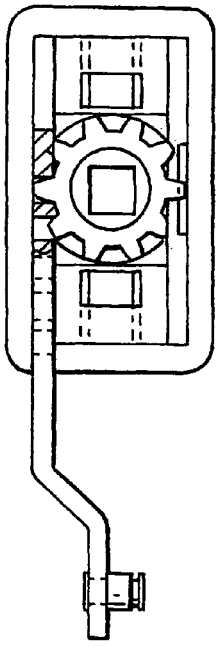
Figure 49D:
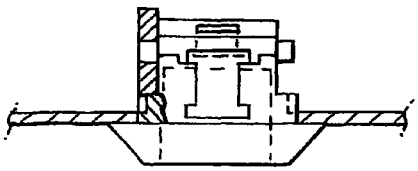
Figure 51A:
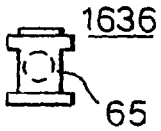
FIGS. 51A and 51B show different views of the associated fastening element.
Figure 51B:
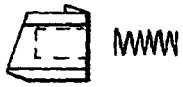
Figure 52A:
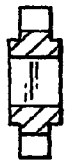
FIGS. 52A and 52B show two different views of the associated pinion.
Figure 52B:
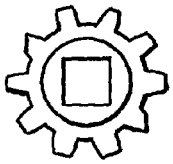
Figure 53:
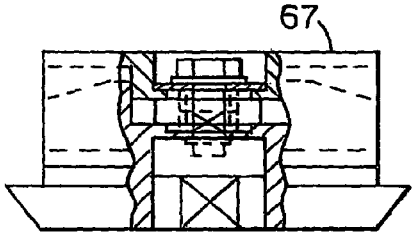
FIG. 53 shows the lock case with the cover arranged thereon.
Figure 54A:
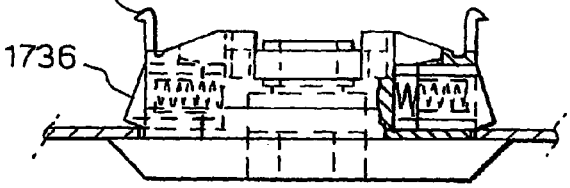
FIGS. 54A to 54D show different views of an embodiment form similar to that shown in FIG. 53, but in which the snap fastening for the cap engages at the front comers in openings.
Figure 54D:
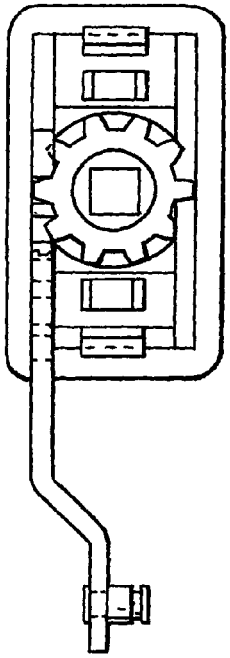
Figure 54B:
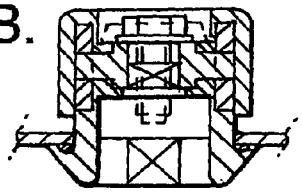
Figure 54C:
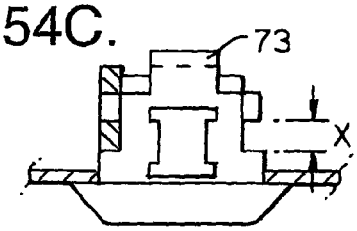

In FIGS. 45A, 45B, the spring 1536 is again shown separately, and the bore hole 143 for the fastening screw 141 and the bore hole 63 for the pinion can also be seen. In the embodiment form according to FIGS. 46A, 46B, a fastening is provided by means of fastening elements (see reference number 1636) which are arranged in a channel. The fastening is carried out with holding elements 1636 which are arranged at the front sides and, since they are somewhat shorter than in other embodiment forms, are guided additionally through a groove shown at 65 (see FIGS. 51A, 51B), while the bearing support of the pinion shown in FIGS. 52A, 52B is carried out in a body part 1632 shown in FIG. 47C. Further, FIG. 53 shows a cover 67 which provides an additional bearing support for the pinion. This cover can be supported either at an offset 69 in the body part of the fitting (see FIGS. 48A, 48B) or at the edges of the latch bars 71 as can be seen in FIGS. 46B, 47B.

Figure 55A:
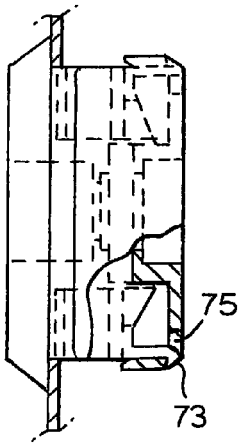
FIGS. 55A to 55D show different views of the lock case according to FIG. 54, but with the cover placed on it.
Figure 55B:
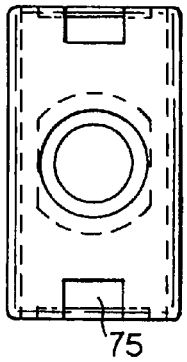
Figure 55C:
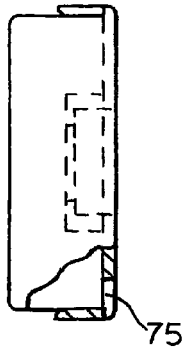
Figure 55D:
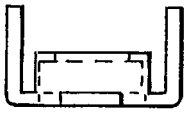

FIGS. 54A, 54B, 54C, 54D show a construction similar to that described above, but in this case the snap fastening for the cap is arranged at the front comers and the latter engage in openings that are formed by the cover which is shown in FIGS. 55A, 55B, 55C and 55D; that is, the hooks 73 engage in the openings 75 shown in FIG. 55C resulting in the mounting shown in FIG. 55A.

Figure 56A:
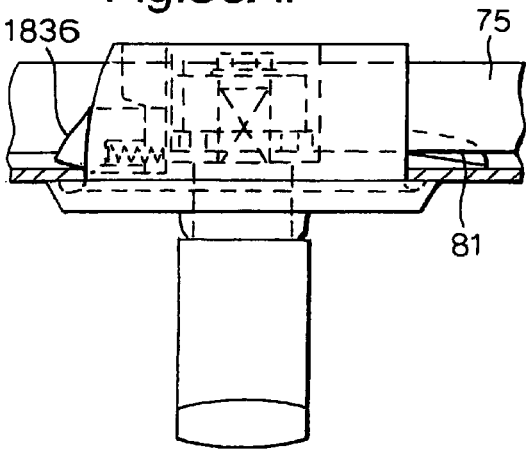
FIGS. 56A to 56B show two different views of a lever actuation with a lock case, wherein fastening is carried out with a hook arrangement on one side and, according to the invention, in a thin wall on the other side.
Figure 56B:
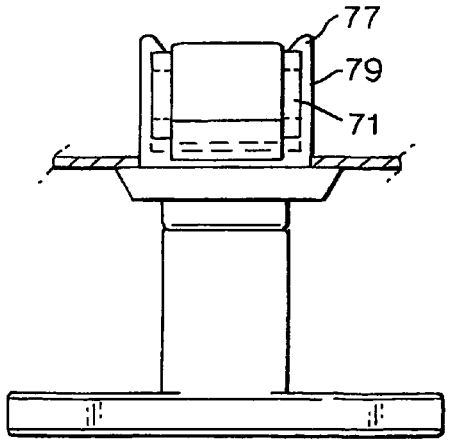
Figure 57A:
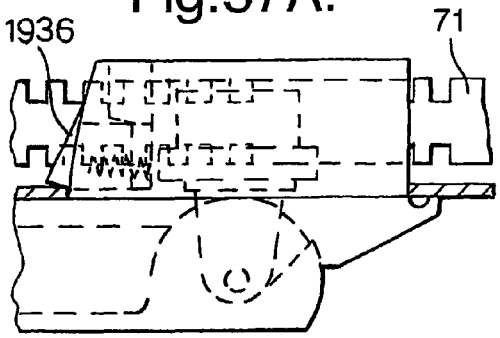
FIGS. 57A to 57C show a construction similar to that shown in FIG. 56, but with a swivel lever.
Figure 57C:
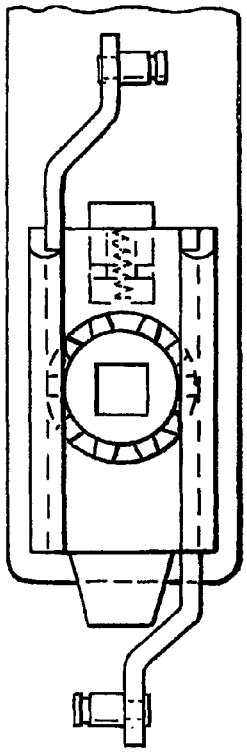
Figure 57B:
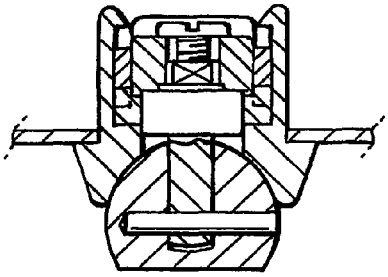

FIGS. 56A, 56B show a toggle latch with a latch bar 75 which operates without a cap and which has a one-part housing instead. Lateral guide webs 79 for the bars carry snap devices 77 and hold the bars in this way. The fastening of the housing is carried out by means of a hook 81 on one side (at right in FIG. 56A) and by means of the holding element arrangement 1836 according to the invention on the other side. FIGS. 57A to 57C show a similar construction, but in a swivel lever.

Figure 58A:
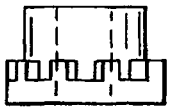
FIGS. 58A and 58B show two different views of the associated pinion.
Figure 58B:
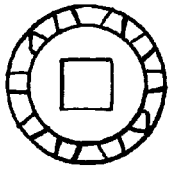
Figure 59A:
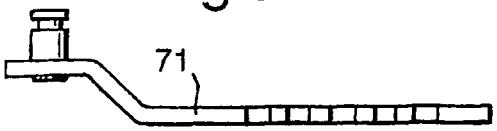
FIGS. 59A and 59B show two different views of the latch bar.
Figure 59B:
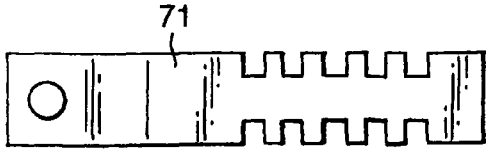
Figure 60:
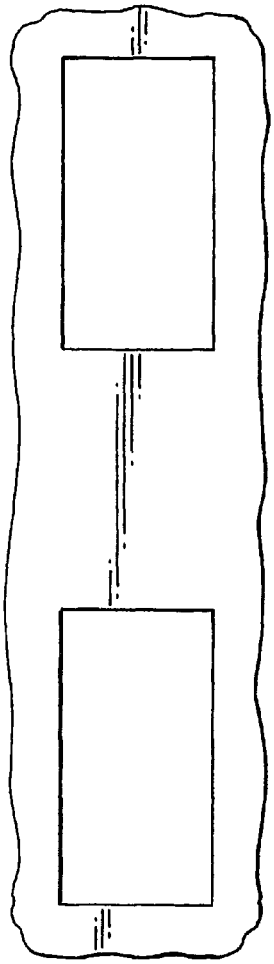
FIG. 60 shows the associated arrangement of openings in a thin wall.
Figure 61A:
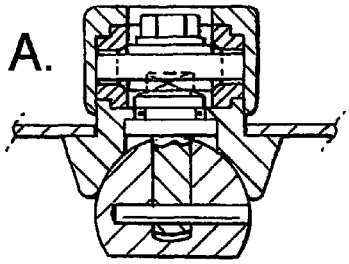
FIGS. 61A and 61B show a swivel lever latch with hooks with a snap element fastening, wherein the cap can be snapped on at the front side and the bar elements therefore provide for a particularly narrow construction, and the bar perforation is expanded at the end for mounting purposes.
Figure 61B:
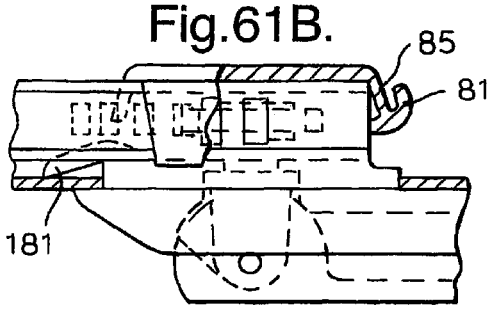
Figure 62A:
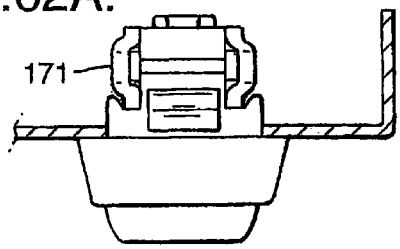
FIGS. 62A and 62B show a possible mounting scheme for locking bars.
Figure 62B:
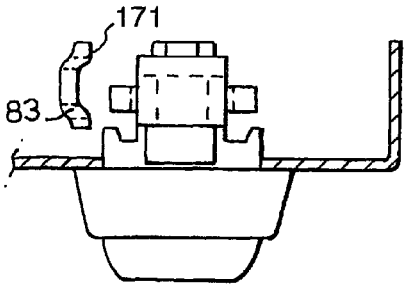
Figure 63:
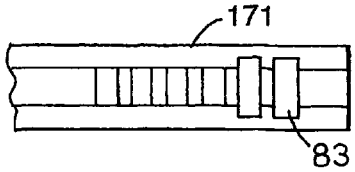
FIG. 63 shows a plan view of the locking bars.
Figure 64:
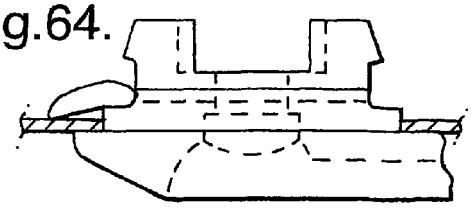
FIG. 64 shows a side view of the swivel lever trough.
Figure 65:
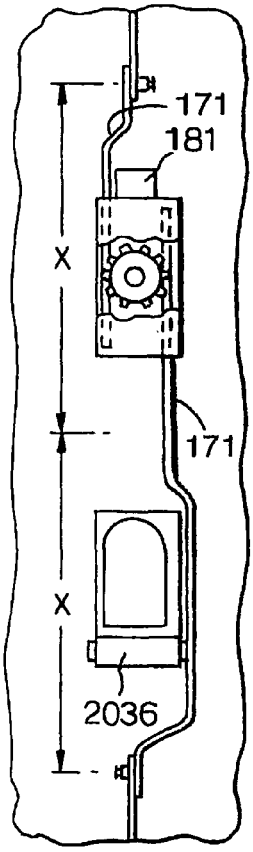
FIG. 65 shows the arrangement of lock parts in a door leaf.
Figure 66:
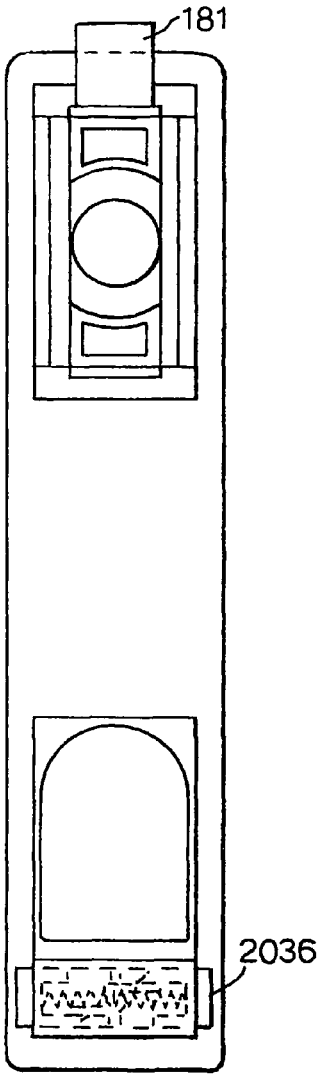
FIG. 66 is a bottom view of the swivel lever latch designed according to the invention.
Figure 67:
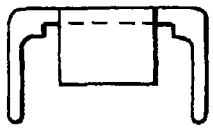
FIGS. 67 and 68 show two different views of the cover.
Figure 68:
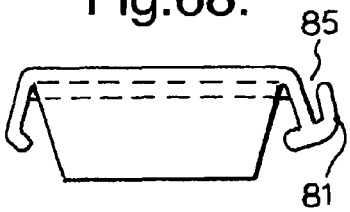
Figure 69A:
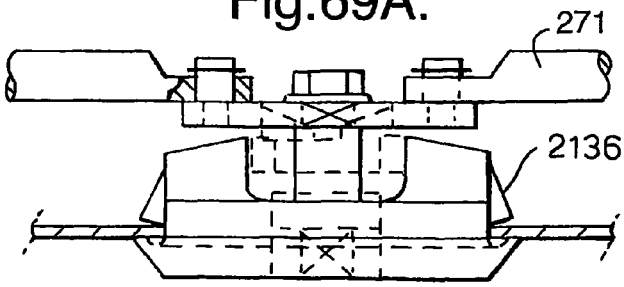
FIGS. 69A to 69C show three different views of a housing which can be snapped in according to the invention and to which is fitted an adapter for wing tongue application and for mounting round bars.
Figure 69B:
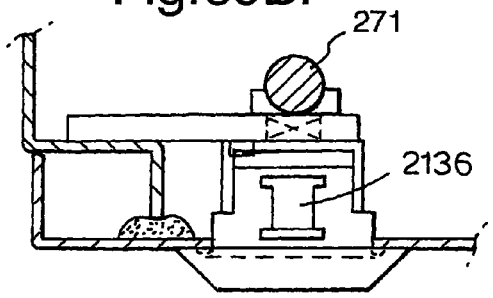
Figure 69C:
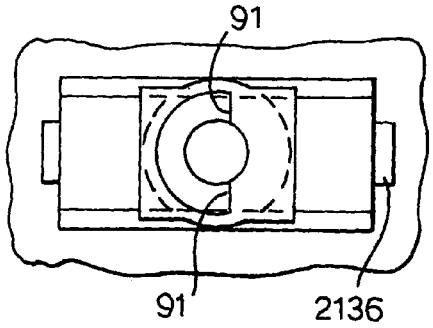
Figure 70A:
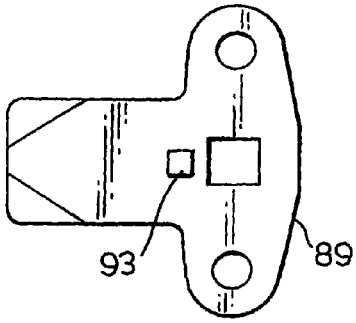
FIGS. 70A, 70B show two different views of the associated wing tongue.
Figure 70B:
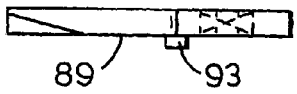
Figure 71A:
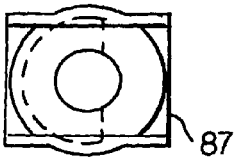
FIGS. 71A to 71C show the associated lock case cover.
Figure 71B:
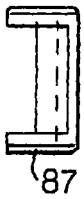
Figure 71C:
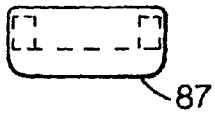
Figure 72A:
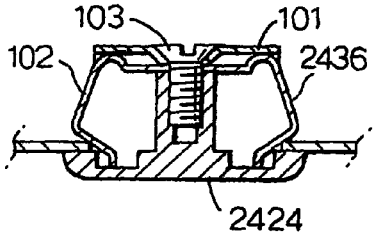
FIGS. 72A to 72D show different views of a spring snap arrangement for fastening on sheet metal.
Figure 72B:
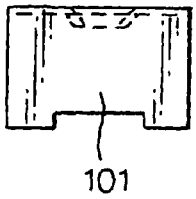
Figure 72C:
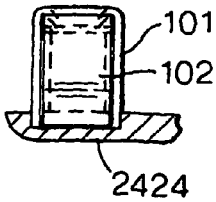
Figure 72D:
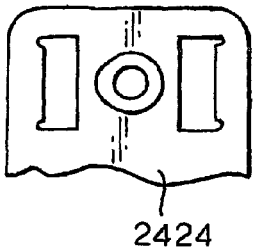

The bars 71 can be inserted from the top against the action of the snap device and engage with the pinion which is shown in more detail in FIGS. 58A and 58B. The bars according to FIGS. 59A, 59B have teeth on both sides to enable a reversal. The swivel lever latch shown in FIGS. 61A, 61B has a hook 181 at one end and a snap fastening according to the invention, 2036, at its other end (see FIG. 66). The cap of the lock case can be snapped on at the front (see FIG. 61B, reference number 81). As can be seen in FIG. 62B, the bars are bent in cross section on both sides resulting in a particularly narrow construction. The bar opening is widened at the end 83 to enable mounting according to FIGS. 62B, 62A. Disengagement of the snap closure of the cover at 81 is facilitated in that a slot 85 is provided in which a screwdriver is inserted so that the snap can be prized out. The embodiment form shown in FIGS. 69A, 69B shows a housing with fastening elements 2136 which is snapped in according to the invention. Mounted on the housing is an adapter 87, shown in FIGS. 71A, 71B, 71C, by means of which a wing tongue 89 shown in FIGS. 70A, 70B can be mounted. Round bars 271 are articulated at the wing tongue as is shown in FIGS. 69A, 69B. The adapter forms stop surfaces 91, see FIG. 69C, against which the protuberance 93 stops in order to limit the rotational path of the wing tongue 89.

FIGS. 72A, 72B, 72C and 72D illustrate an embodiment form showing a holding device 2436, according to the invention, in the form of a spring snap arrangement for fastening a fitting such as a hinge or latch in a thin wall. When producing the head part 2424 by injection molding, for example, no sliders are needed in the injection mold because the channel is formed by an inexpensive separate part 101. Like the separate U-shaped part 101, an integrated leaf spring 102 is held by a countersunk head screw 103 which is screwed into the head part 2424. Also, the leaf spring 102 can be produced inexpensively.

Figure 73A:
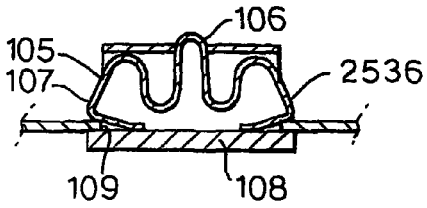
FIGS. 73A to 73C show three different views of a leaf spring snap fastening with a channel construction for latches.
Figure 73B:
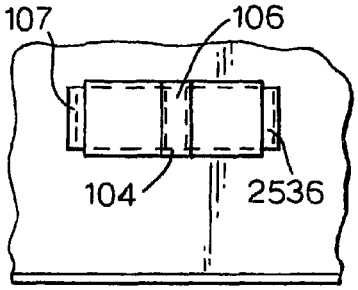
Figure 73C:
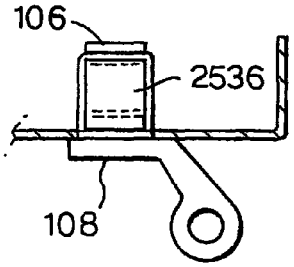

FIGS. 73A, 73B and 73C show three different views of a leaf spring snap fastening with channel formed at the back of the hinge or latch. As is shown, the channel 2536 which will be described more fully in the following is open at the top so that a slot 104 is formed. A specially shaped leaf spring 105 according to FIG. 73A can be inserted at the side. The heightened middle area 106 can deflect downward and finally locks into the slot 104 and no longer permits a longitudinal displacement of the spring 105. The two projecting ends of the leaf spring, reference number 107, now act like linearly displaceable springs for the snap elements and hold the fitting part, e.g., a hinge device, securely in the rectangular installation opening 109. This embodiment form can be used in hinges as well as in latches and represents an enormous economy.

Figure 74A:
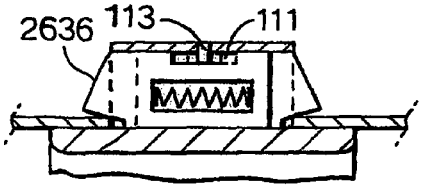
FIGS. 74A to 74C show three different views of a snap fastening according to the invention.
Figure 74B:
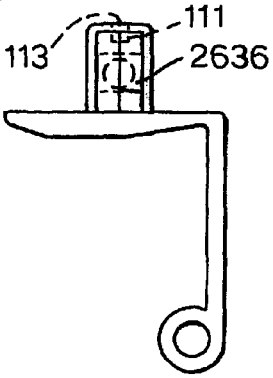
Figure 74C:
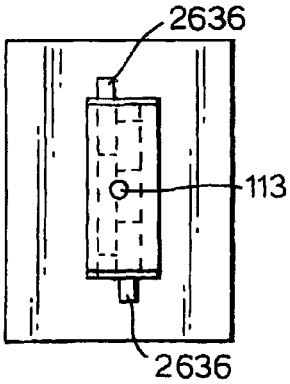
Figure 74D:
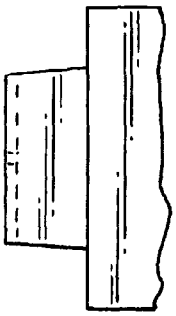
FIG. 74D and 74E show two other views.

FIGS. 74A, 74B, 74C, 74D and 74E show another embodiment form of the invention in which two holding elements 2636 which are movable relative to one another are supported in a channel so as to be displaceable relative to one another against spring force. The movement of the elements 2636 is limited linearly by a notch 111 in which a headless screw 113 engages. The embodiment forms according to FIGS. 74A to 74C show an arrangement which is economical but also easy to mount. The flat sheet-metal parts to be used can be stamped cheaply. When installed, but not yet mounted on the cabinet sheet metal, the two openings of the sheet-metal parts are congruent even when the pressure spring is biased. The three parts, namely, the two snap plates and one pressure spring, which are biased, form a stable assembly in itself so that it can be inserted into the guide channel in a simple manner. The pin which is then pressed in only prevents the unit from falling out. The snap plates do not develop a relative movement caused by the springs until mounted in the installation opening. The entire arrangement is very narrow and therefore saves space. In special situations, solitary snap plates can also be provided, and they can be bent to accommodate to cramped conditions.

Figure 76A:
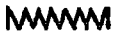
FIGS. 76A to 76C show the spring, a screw and a pin as component parts of the fastening device according to FIGS. 74A to D.
Figure 76B:
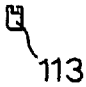
Figure 76C:
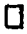

FIG. 76A shows the pressure spring. FIG. 76B shows the headless screw. A pin shown in 76C can also be used instead of the headless screw, but could not be disassembled.

Figure 74E:
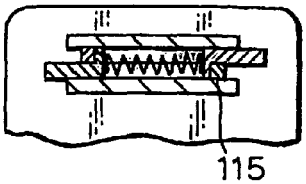
Figure 75A:
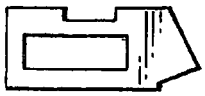
FIGS. 75A and 75B show two views of the associated slider.
Figure 75B:
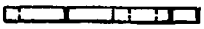

FIG. 74E shows how the parts can contact one another in the guide channel. An eversion 115 on one side for the opening makes possible a full-surface contact of the spring at the end.

Figure 77A:
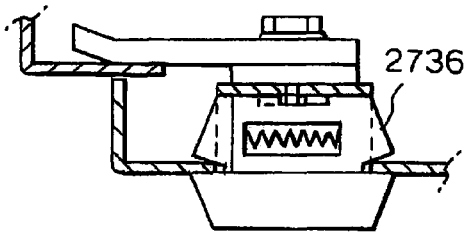
FIGS. 77A to 77C show three different views of a fastening element similar to that shown in FIGS. 74A to C, but in this case for a sash latch.
Figure 77B:
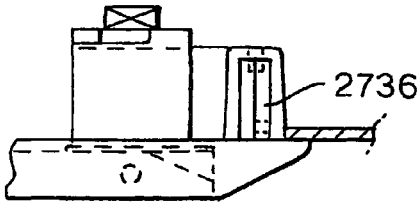
Figure 77C:
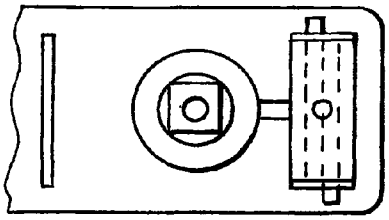

FIGS. 77A, 77B and 77C show a similar embodiment form in which the fastening 2736 according to the invention is used in a swivel lever. The swivel lever drives a sash which secures the door in a frame when the door is closed.

Figure 78A:
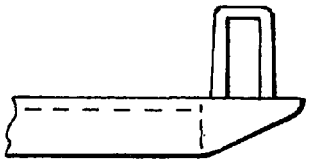
FIGS. 78A and 78B show detailed views of the latch trough with its fastening device.
Figure 78B:
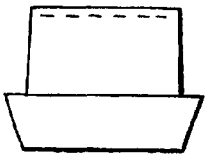
Figure 79A:
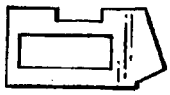
FIGS. 79A and 79B show two different detailed views of the slider.
Figure 79B:
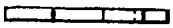

FIGS. 78A, 78B show details of the trough area to be placed in the door leaf, while FIGS. 79A, 79B show two views of the slider.

Figure 80A:
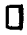
FIGS. 80A and 80B show a headless screw and a spring belonging to the latch according to FIGS. 77A to 77C in detail.
Figure 80B:
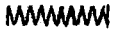

FIG. 80A again shows a headless screw, and FIG. 80B shows a wire spring.

Figure 81A:
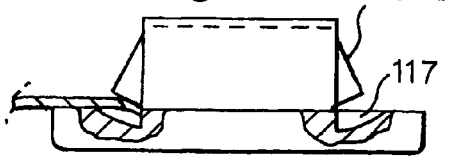
FIGS. 81A and 81B show two different views of a snap hinge in which sheet-metal bulges according to FIG. 84 are not detrimental.
Figure 81B:
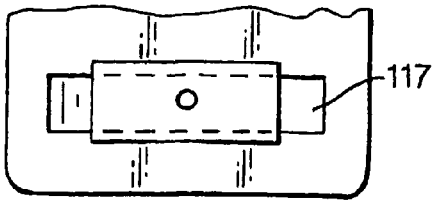

FIGS. 81A, 81B show an embodiment form which solves the problem that occurs when the loading of the snap elements at the sheet-metal edge is too high and causes an outward bulge. In this case, in the embodiment forms described above, the hinge leaf no longer makes clean contact. In order to solve this problem, an offset in which the bulge 119 is received is created in the area of the snap element on the inner side of the hinge leaf (see reference number 117). The snap element 2836 pushes forward, and secure fastening is still ensured without disadvantages.

Figure 81C:
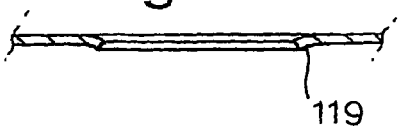
FIG. 81C shows the sheet-metal bulges at the rim of the opening.

FIG. 81C shows a sectional view, at 119, of the bulging sheet metal which can result from high loading at the high edges.

FIG. 81A is a side view of the channel construction with snap elements and offset. FIG. 81B shows a rear view of the channel construction without the snap pieces but with the offset for receiving the bulge.

Figure 82A:
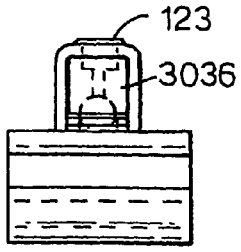
FIGS. 82A, 82B and 82C show three different views of another embodiment form of the invention.
Figure 82B:
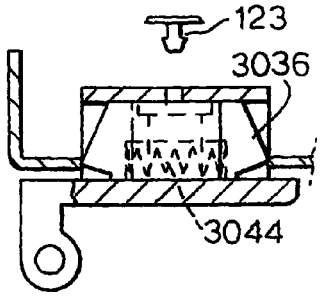
Figure 82C:
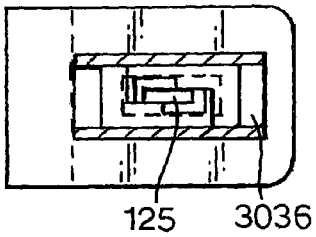
Figure 82D:
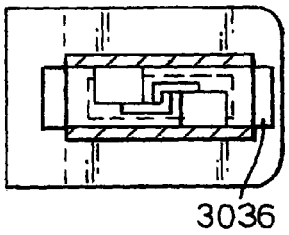
FIG. 82D shows a view similar to that in FIG. 86C, but with the holding elements moved out.
Figure 82E:
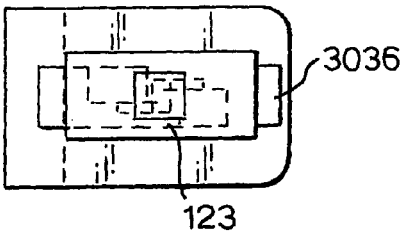
FIG. 82E is a view similar to that in FIG. 86D.

In the embodiment form shown in FIGS. 82A to 82C, the fixing plug 123 which engages in a slot 125 formed by the holding elements 3036 is not loaded by spring 3044 because the oppositely located holding elements 3036 hold one another mutually. The fixing plug 123 holds the holding elements 3036 only in the correct (center) position so as not to interfere with the snap-in process.

The construction enables simplified mounting, and only one spring 3044 is used because the center intermediate wall in the channel which was provided in the other embodiment forms is dispensed with in this case.

Figure 83A:
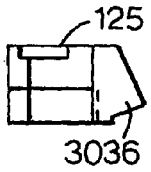
FIGS. 83A to 83C show three different detailed views of the holding element used in FIGS. 82A to 82E.
Figure 83B:
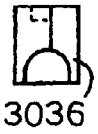
Figure 83C:
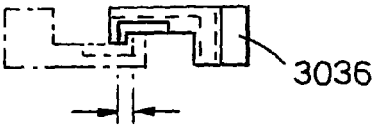

FIGS. 83A and 83C show the associated holding elements 3036 as individual parts.

Figure 84A:
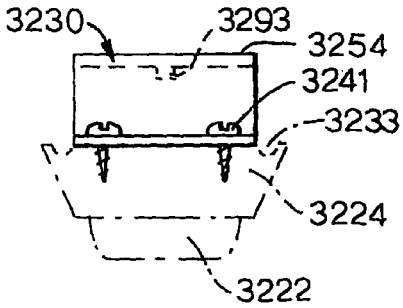
Figure 84B:
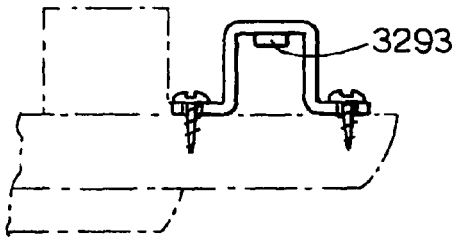
Figure 84C:
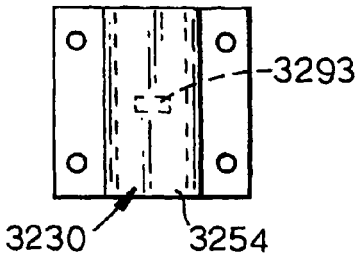

FIGS. 84A to 84C show three different views of a top 3230 which forms the guide channel and which can be screwed on. As regards tools or dies, this is advantageous for arranging channels 3233 for a seal 3233. It is not necessary to work with slides in the die. When the guide channel part is screwed on, the center fixing projection 3299 can be produced by pressing out (sheet-metal part) or casting (pressure die casting, plastic injection molding). The fixing plug 123 which was described in the preceding embodiment form (FIGS. 82A to 82E) would not be needed in this case.

Figure 85A:
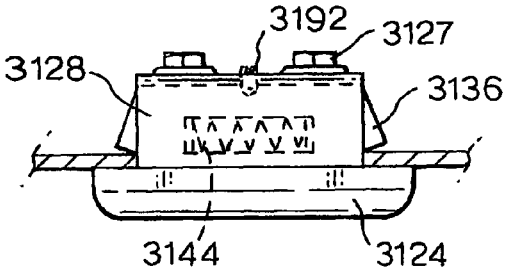
FIGS. 85A to 85C show three different views of an embodiment form for heavy loading in which four snap plates form the holding elements.
Figure 85B:
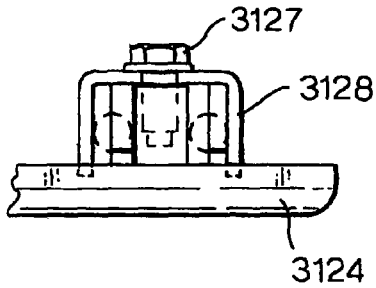
Figure 85C:
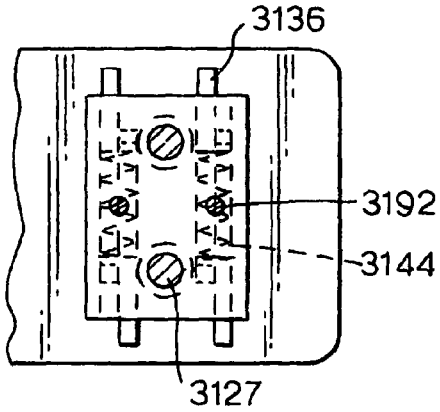

FIGS. 85A to 85C show three different views of an embodiment form in which a particularly heavy load capacity is achieved by an arrangement of four snap plates 3136. The U-part for forming the guide channel 3128 is screwed on in this instance. Supporting U-legs are recessed into the back side of the head part 3124. The snap plates move between the screw cylinders 3127 and in the inner wall of the U-part.

Figure 86A:
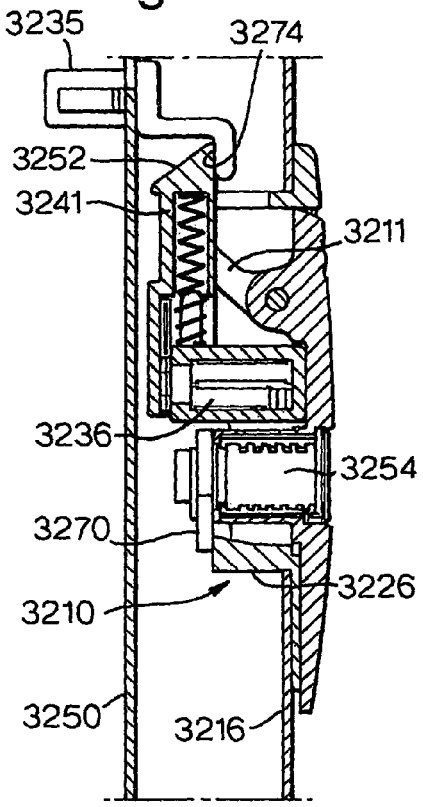
FIGS. 86A, 86B, 86C and 86D show different view of a folding lever latch with fastening according to the invention in the folded-in position.

Another example for a fastening, according to the invention, of a latch is described with reference to FIGS. 86A to 86G. FIG. 86A shows an axial sectional view of a folding lever latch 3210 which is arranged in a rectangular opening in a thin wall such as a door leaf 3216. The folding lever latch has a head part 3224 which is to be arranged on one, outer side of the thin wall 3216 and which overlaps the outer rim of the opening, and a body part 3226 which proceeds from the head part 3224 and projects through the opening in the mounted position, and holding elements 3236 which project from the body part 3226 and are flexible in direction of the outer surface of the body part 3226, the free end of these holding elements 3236 being provided with an inclined surface 3238 for supporting the body part 3226 without play on the rim or the edge of the opening of the other, inner side of the thin wall 3216. The body part 3226 and holding element 3236 are two separate parts. The holding element 3236 is supported in the body part so as to be displaceable against spring force axially in a direction transverse to the longitudinal extension of the folding lever. The body part 3226 and head part 3224 are formed in one piece.

When the latch arrangement 3210 is in the mounted position, an operable folding lever 3222 which is mounted so as to be swivelable around an axis 3221 in the body part 3226 prevents swiveling out through the tongue 3270 of a cylinder lock 3254 in the position shown in FIG. 86A in which the tongue rests on a projection of the body part 3226. In this closed position, a catch-type bolt 3252 which is displaceable against spring force engages behind a back-engagement surface 3274 which is formed or carried by the door frame 3250 and is formed in the present instance by a hook which is fastened in turn with a holding element 3235 according to the invention at the door frame 3250 so as to be insertable.

Figure 86B:
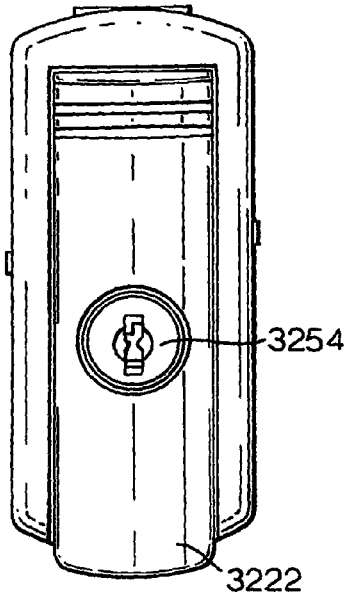
Figure 86C:
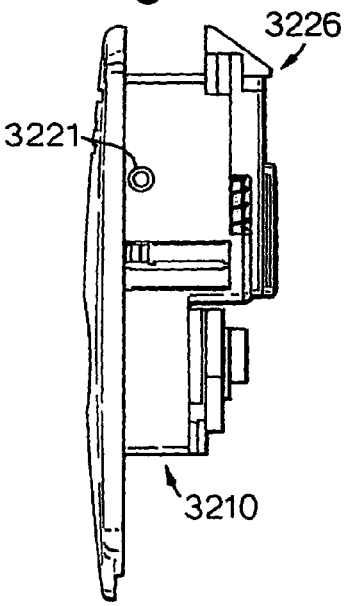
Figure 86D:
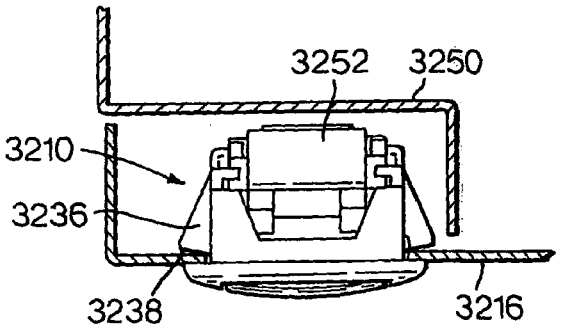

FIG. 86B shows a front view of the latch according to FIG. 86A, FIG. 86C shows a side view and FIG. 86D shows a top view of the latch 3210 which is installed in the door leaf 3216 and extends into the bend space formed by the door leaf 3216 and door frame 3250.

Figure 86E:
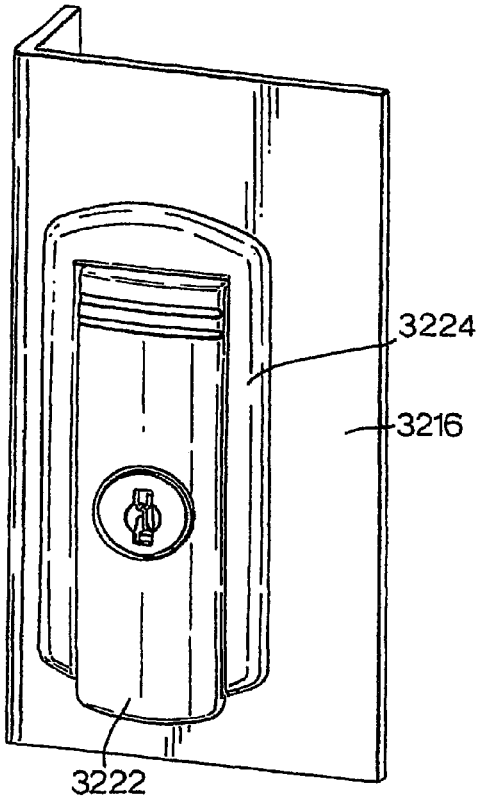
FIG. 86E shows a perspective view of the folding lever latch in the folded-in position.
Figure 86F:
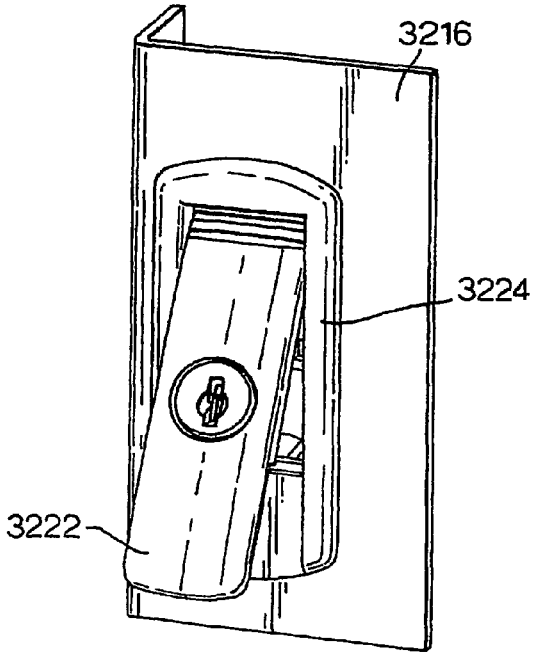
FIG. 86F shows a perspective view of the folding lever latch in the folded-in position.

FIG. 86E shows a perspective view of the portion of the locked latch that is visible from the outside. FIG. 86F shows the same view of the opened latch, in which state a projection 3211 which is connected to the lever 3222 so as to be rigid with respect to rotation pulls the catch bolt 3252 back against the force of the spring 3241 until the bolt is released from the hook or offset surface 3274 and the door can be opened. This position is shown in FIG. 86F.

Figure 86G:
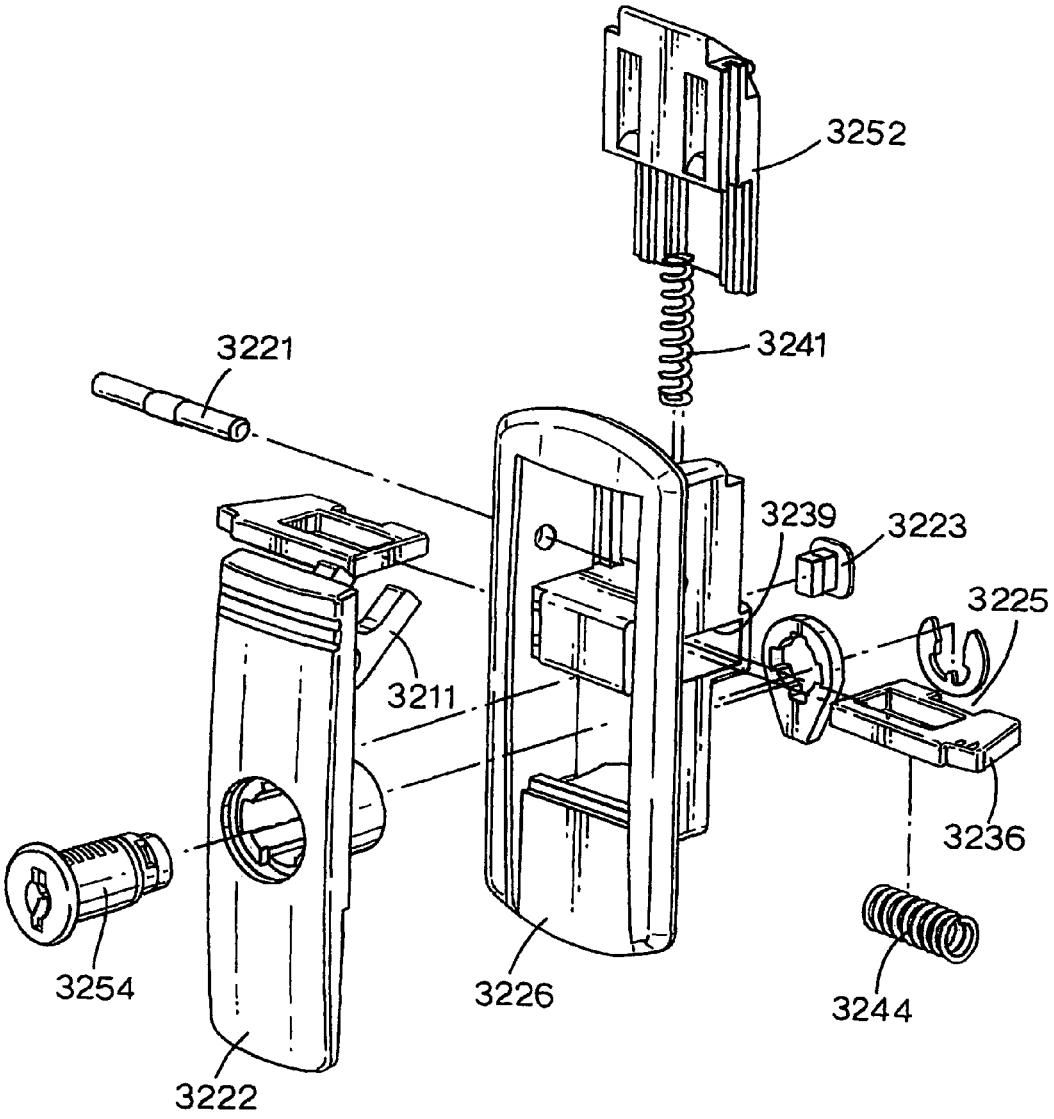
FIG. 86G shows an exploded view of the folding lever latch.

Further details can be seen from FIG. 86G which shows an exploded view of the individual parts of the latch according to the invention.

Reference is had in particular to the channel 3239 of the body part of the latch according to the invention, in which the two holding elements 3236 are accommodated next to one another in opposite directions under the spring force of a respective spiral spring 3244.

A blocking plug 3223 engages in an offset area 3225 of the holding element 3236 and limits the path of the holding element 3236.

Figure 87A:
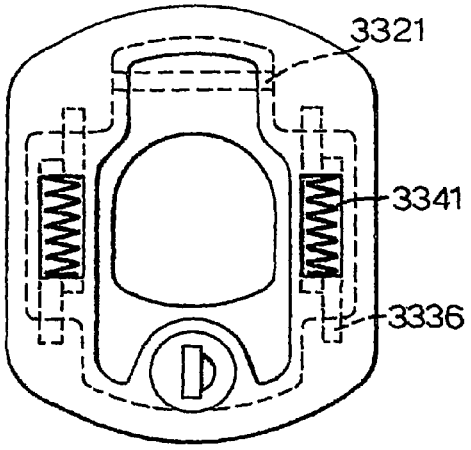
FIGS. 87A and 87B show two views of another latch with fastening according to the invention in an opening in a thin wall.
Figure 87B:
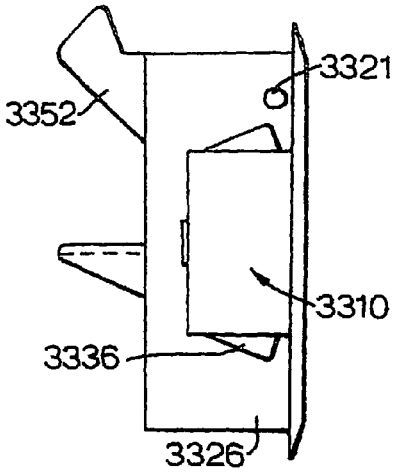
Figure 87C:
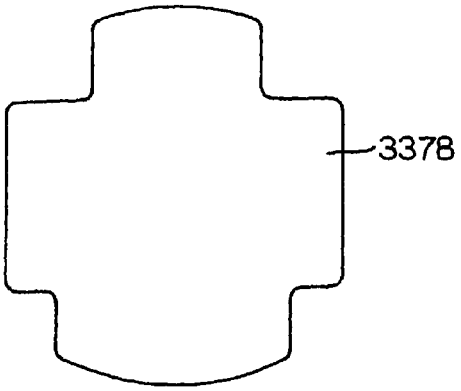
FIG. 87C shows the associated opening.

In the embodiment form shown in FIGS. 87A, 87B, which can be exposed to particularly high loads, the shape of the cutout (see FIG. 87C) is somewhat more complicated, that is, it deviates from the rectangular shape. The four associated holding elements 3336 are provided as two pairs of two oppositely directed elements 3336 each and are oriented in the direction in which the tongue extends, in contrast to the embodiment form according to FIG. 86G in which the holding elements 3236 are arranged perpendicular to this direction.

FIGS. 88A to 88G show different views of a pull-type turn lock or sash latch which is fastened by means of holding elements according to the invention in an opening in a thin wall such as a sheet-metal cabinet door.

Figure 88A:
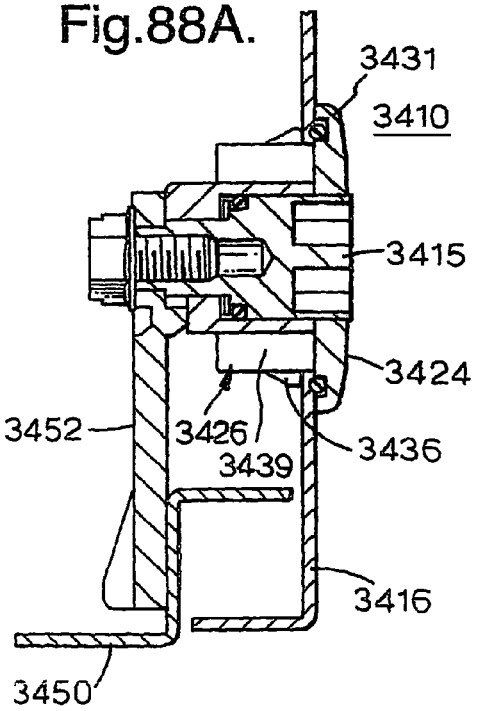
FIGS. 88A to 88G show different views of a sash latch having fastening elements according to the invention.

FIG. 88A shows an axial section through the sash latch 3410 installed in a rectangular opening 3478 in the door leaf 3416. In the position shown in FIG. 88A, a sash fastener or turn lock 3452 engages behind a back-engagement surface formed by the door frame 3450. Located above and below the bearing housing for the drive shaft for the turn lock 3452 are the holding elements 3436 which are accommodated in channels 3439. When the body part 3426 is pushed through the rectangular opening 3478 in the door leaf 3416, these holding elements 3436 engage behind the opening edges on the inner surface of the door leaf and secure the latch 3410.

According to FIG. 88D which again shows an axial sectional view, the tongue 3450 and body part are shaped in such a way that, without disassembling the tongue part 3452, the latch can extend up to the holding surface 3438 having the relatively steep inclined surface through the opening 3478 initially with the tongue and then with the holding elements which can deflect backward into the channel 3439 against the spring force of the pressure springs 3444. The steepness of this inclined surface is such that a rearward deflection along this surface does not take place even when high forces occur and that the fastening will not release even in the event of strong compressive forces or vibrating forces proceeding from the tongue. Rather, the holding elements 3426 would have to be pushed back into the channel 3439 by force with a tool in order to remove the sash latch 3410 from the opening 3478 of the door leaf 3416. Since the back of the door leaf must also be accessible, this can only be done when the door wall is open, that is, not when the sheet-metal cabinet is closed. Accordingly, the sash latch according to the invention is to be mounted but not removed from the outside. This provides for security as well as simplicity of mounting and robustness of the mounting connection. Further, there are no loose parts which could fall into the switching cabinet and cause short circuiting.

Figure 88B:
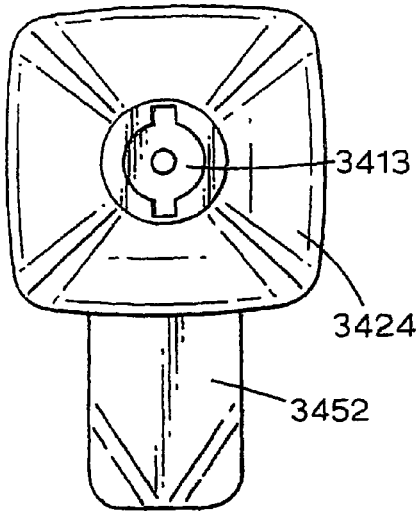
Figure 88C:
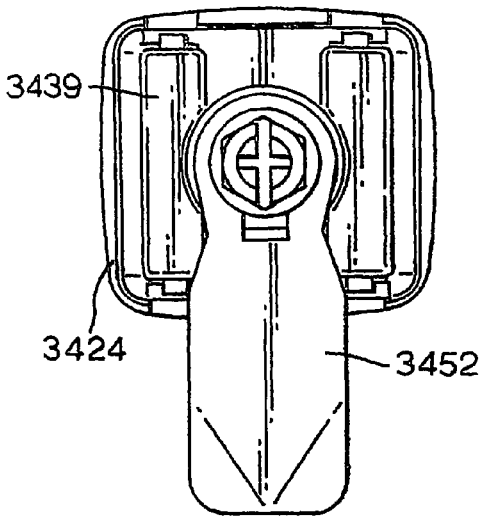
Figure 88D:
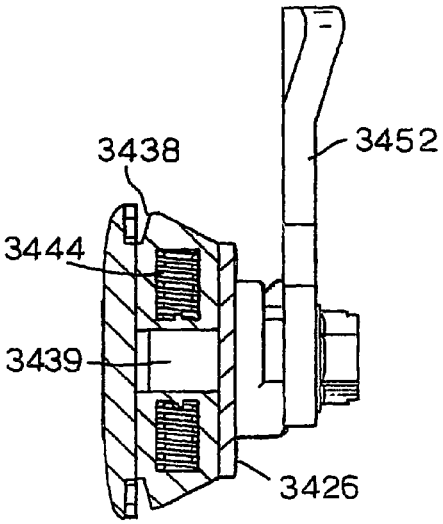
Figure 88E:
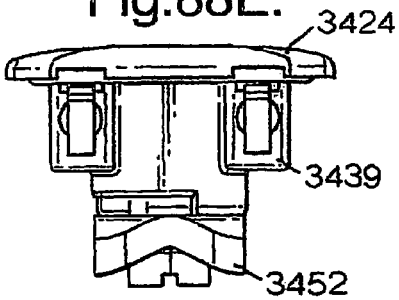
Figure 88F:
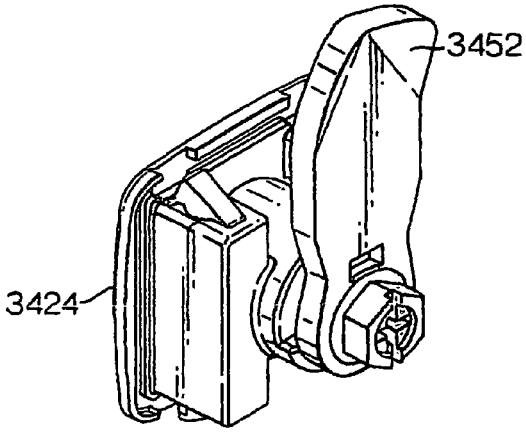
Figure 88G:
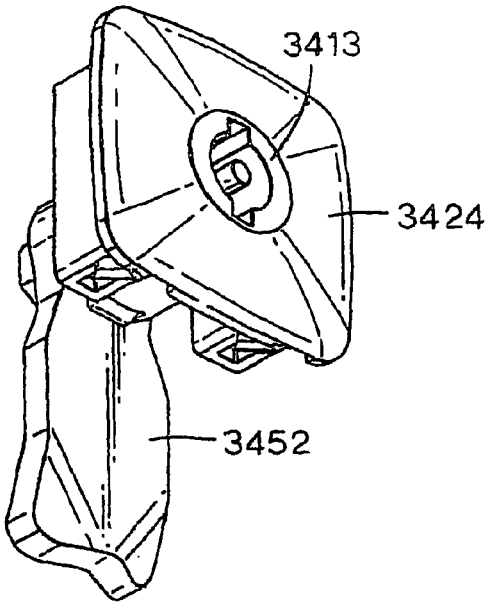
Figure 89:
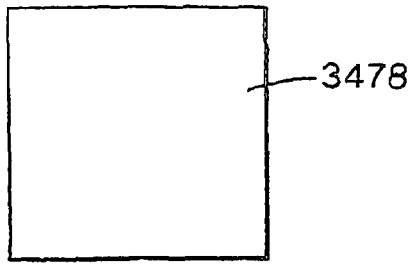
FIG. 89 show the associated opening in a thin wall.

Sealing means are also possible, for instance, the seal arranged in the support surface of the head part 3424 designated by reference number 3431. To further illustrate the construction of the turn latch according to the invention, FIG. 88B shows a top view of the head part or flange 3424 with the socket wrench drive 3413, shown in the present instance, for a shaft 3415 which presents another possible actuation. In a manner known per se, the shaft 3415 has a square for a turn bolt 3452 at its end projecting from the body part 3426. The turn bolt 3452 is held by means of a head screw which is screwed into a corresponding thread in the shaft 3415. FIG. 88C shows a view of the back of the latch. FIG. 88E shows a side view in direction of the tongue, and FIGS. 88F and 88G show two perspective views for further illustrating the construction of the latch arrangement 3416 according to the invention.

Figure 90A:
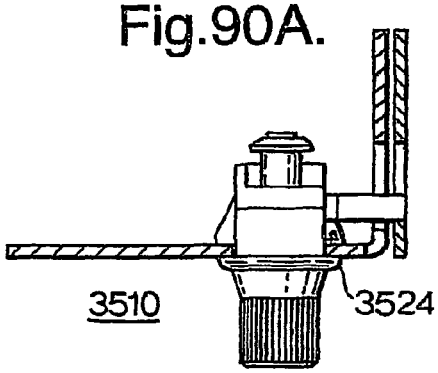
Figure 90B:
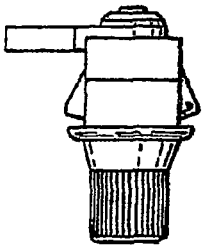
Figure 90C:
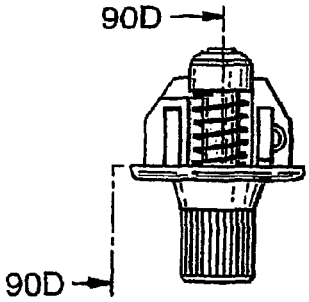
Figure 90D:
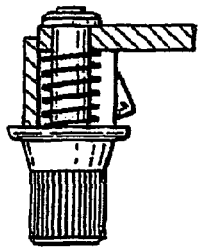

FIG. 90A shows a pull-type turn bolt latch which can be inserted into an opening 3578 in a thin wall such as a sheet-metal cabinet door 3516 for example. The head part 3524 supports a shaft 3515 with an actuating knob. At the same time, two channels forming a body part 3426 proceed from the head part 3524 for holding elements 3536 with associated spring 3544. Two opposed holding elements 3536 which are arranged below and above the shaft 3515 guarantee sufficient stability. A pull-type turn bolt 3552 is fitted on the end of the shaft 3515 over a disk or a spring. The turn bolt 3552 is linked to the actuating knob by the shaft 3515 in such a way that a lifting movement away from the turn knob 3515 is carried out in the first part of the rotation (when opening), and a turning movement also occurs after a partial rotation due to friction. The turn bolt moves upward from the position shown in axial section in FIG. 90A, for which purpose the corresponding L-shape formed by an opening in the frame accommodates this movement of the tongue. As a result of the lateral movement path of the actuating knob, the turn bolt 3552 accordingly executes a movement out of the opening in the frame, whereupon the thin wall 3516 is released from the frame 3550 and makes it possible for the thin wall 3516 to be removed from the frame. The thin wall 3516 can be part of a drawer which can be removed from a drawer frame.

Figure 50:
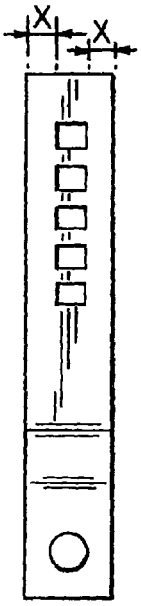
FIG. 50 shows the associated lock bar.
Figure 90E:
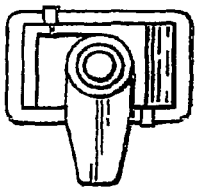
Figure 90F:
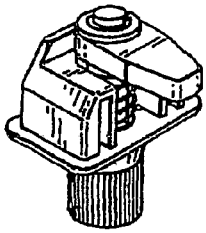
Figure 90G:
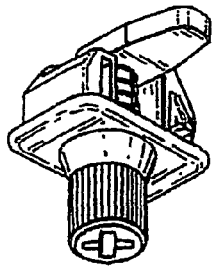
Figure 90H:
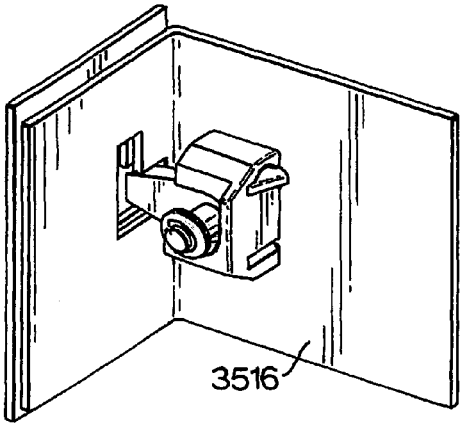
Figure 90I:
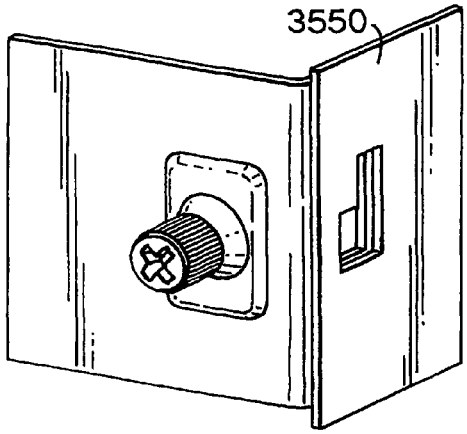
Figure 90J:
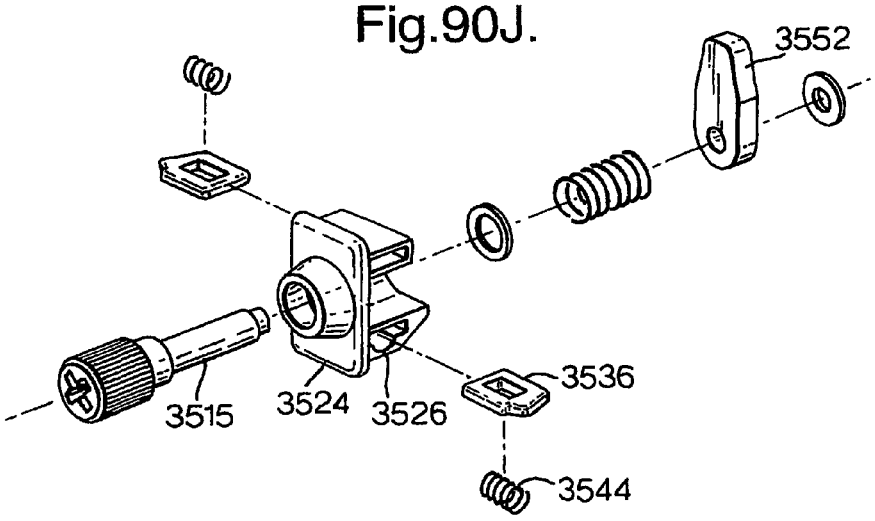
FIG. 90J shows an exploded view of the above-mentioned pull-type sash lock.
Figure 91:
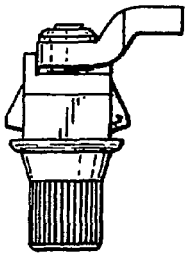
FIG. 91 shows the above-mentioned sash lock, but with a bent tongue.
Figure 92:
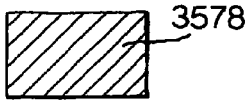
FIG. 92 shows the associated opening in a thin wall.
Figure 93A:
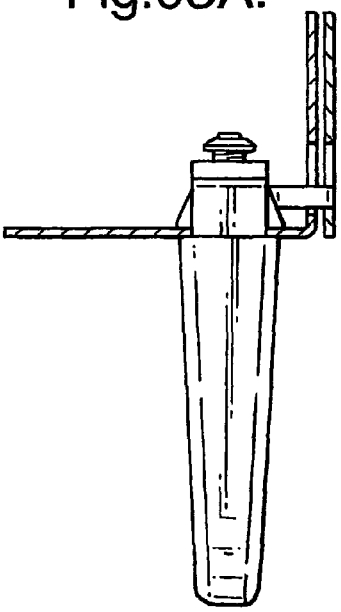
FIGS. 93A to 93I show different views of a pull-type sash lock having fastening elements according to the invention and a finger grip.
Figure 93B:
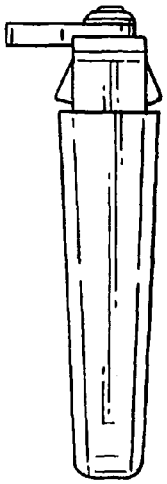
Figure 93C:
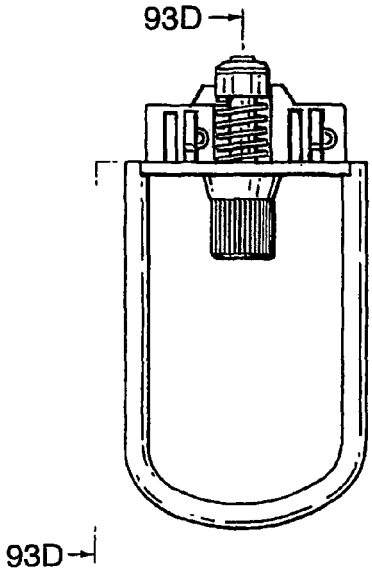
Figure 93D:
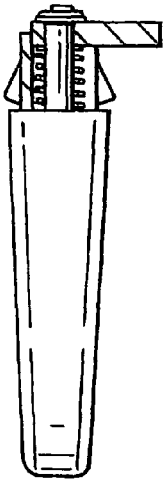
Figure 93F:
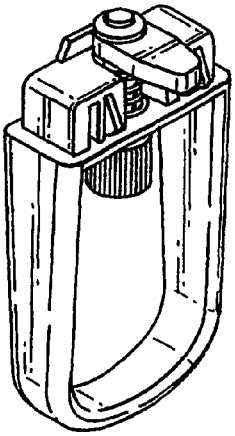
Figure 93G:
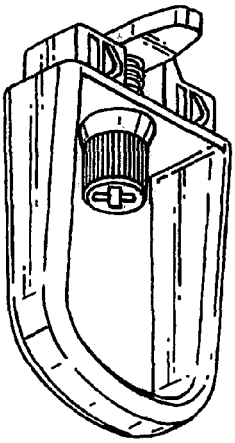
Figure 93E:
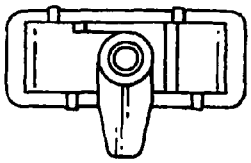
Figure 93H:
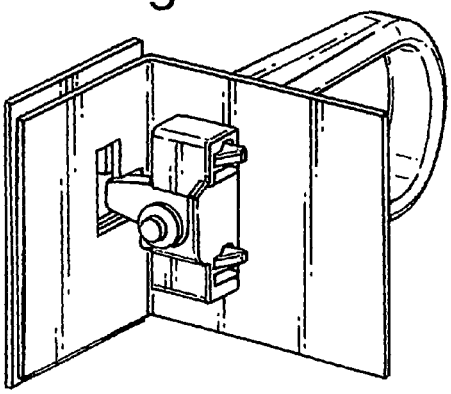
Figure 93I:
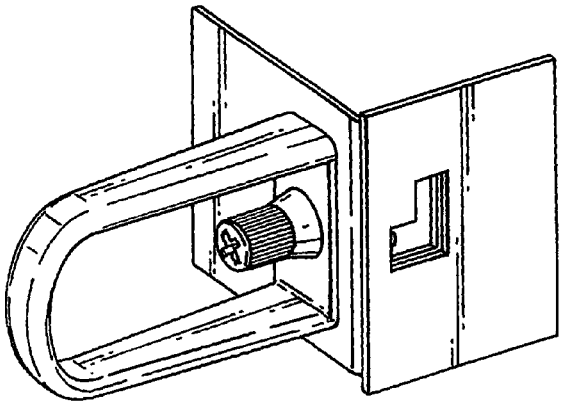
Figure 93J:
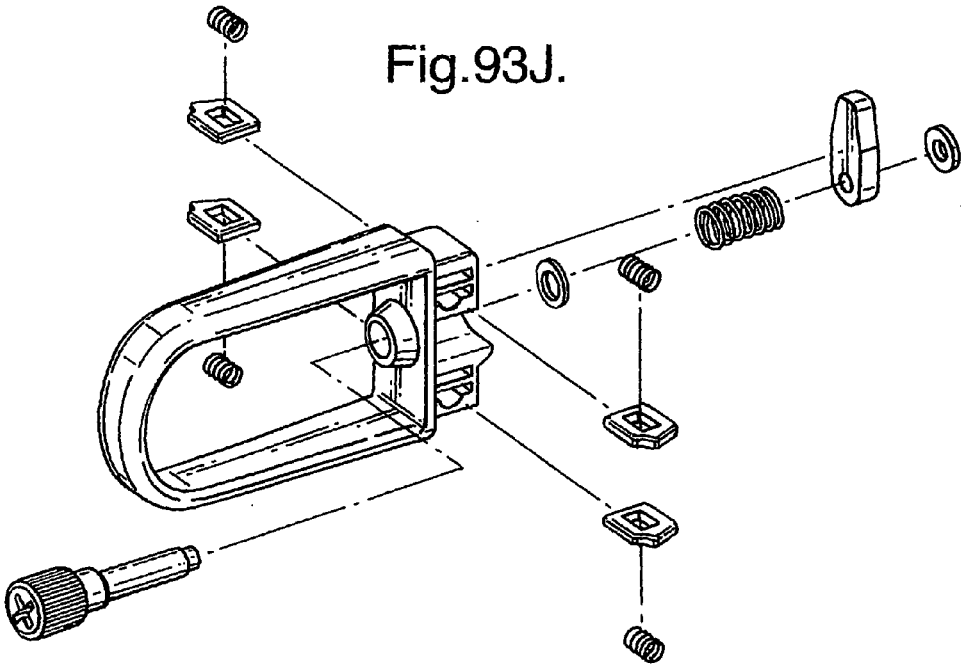
FIG. 93J shows an exploded view of the above-mentioned pull-type sash lock with a finger grip.
Figure 94:
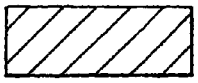
FIG. 94 shows the associated opening in a thin wall.

Stops at the housing rim along which the tongue 3552 slides (see the rear view in FIG. 90E) limit the rotating path of the bolt 3552, e.g., between a 90-degree closed position shown in FIG. 50G and an open position. FIG. 90F further illustrates the construction and function of the latch. As is shown in FIG. 91, it is possible to bend the tongue 3552 in an optional manner in order to adapt to the distance between the supporting wall and the offset surface to be gripped.

FIG. 93A to FIG. 93J show how the latch which has already been described can be additionally provided with a finger stirrup to facilitate pulling out the drawer in case it jams. Otherwise, the latch does not differ from the embodiment form described with reference to FIGS. 90A to 90J. However, it has arrangements of 2×2 fastening elements as can be seen from FIG. 93J. Accordingly, this latch can absorb greater forces than the latch according to the preceding embodiment form.

The invention is commercially applicable in switch cabinet construction.

While the foregoing description and drawings represent the present invention, it will be obvious to those skilled in the art that various changes may be made therein without departing from the true spirit and scope of the present invention.

REFERENCE NUMBERS

10, 3210, 3410 swivel lever latch, sash latch
3211 projection
12 rectangular opening
3413 socket wrench drive
14 rectangular opening
3415 drive shaft
16, 216, 416, 3216 3416, 3516 thin wall, door leaf
17 center web
18 outer side
20 rim
123, 223 blocking pin, fixing plug
22, 3222 swivel lever, hand lever
24, 324, 2424, 3124, 3224, 3424, 3524 trough, head part
3225 offset
26, 326, 526, 3226, 3426 body part, U-part
27, 3127 head screw, screw cross section
28, 128, 3128 holding element; body part, guide channel
29, 3929 elongated hole channel
30, 3230 body part, receiving area, top
31, 3431 grooves
32, 1632 body part
33, 3233 sealing rings, channels
34 outer surface of the body part
35 groove
3235 holding element
36, 136, 236, 336, 436, 536, 636, 736, 836, 936, 1036, 1136, 1236, 1536, 1636, 1836, 2036, 2136, 2236, 2436, 2536, 2636, 2736, 2836, 3036, 3136, 3236, 3336 holding element or tongue element, snap elements, lock parts, lever
37 threaded bore hole
38, 3238, 3438 inclined surface
39, 3239, 3439 receiving pocket hole, channel
40 edge
41, 141 screw
42 inner side of the thin wall
143,443 hole
3241 spring
44, 244, 344, 3244, 3044, 3444 spring
46 locking element
48 locking element
49 cut edge
50, 250, 450, 3250, 3450, 3550 frame, door frame
51 slot
52, 3252, 3452, 3552 sash latch tongue
53, 153 toothing
54, 354, 3254 cylinder
55, 155 toothing
56 slide
57, 157 U-spring
58, 358 wall
59 spring end
60 axis
61 second inclined surface
62 axis of the trough
63 bore hole
64 rotatable cross-stop
65 groove
66 drive shaft
67 cover
68 axis, perpendicular to the door leaf
69 offset
70, 170, 3270 tongue, cam
71, 171 latch bars
72 screw
73 hook
74, 174, 3274 offset surface, spring back-grip
75 openings
76 key
77 snap devices
78, 3378, 3478 rectangular opening
79 guide web
80 bottom, first hinge part
81, 181 hook, cover
82, 282, 382 second, top hinge part
83 widening
84 hinge pin
85 slot
86 bore hole
87 adapter, rectangular opening
88, 388 tab
89 wing tongue
90 offset
91 stops
92, 192, 292 pin, wedge
93 protuberance
3293 fixing projection
94 opening in part 336
95 undercut
96 wall opening
97 hook
98 conical screw
100 hook
101 separate part
102 leaf spring
103 countersink head screw
104 slot
105 leaf spring
106 middle area
107 leaf spring
109 installation opening
111 notch
113 headless screw
115 eversion
117 offset
119 bulge
123 fixing plug
125 slot

The invention claimed is:

1. A latch for mounting in openings in a thin wall, comprising:

a head part which is to be arranged on one, outer side of the thin wall and which overlaps an outer rim of the opening;

a body part which proceeds from the head part and projects through the opening in the mounted position;

holding elements which project from the body part and are displaceable in direction of the holding elements' outer surfaces, a free end of said holding elements being provided with a first inclined surface for supporting the body part without play on the rim or edge of the opening of an other, inner side of the thin wall;

wherein the supporting first inclined surface is inclined with respect to the inner side of the thin wall, and rests on the rim or edge of the opening of the inner side of the thin wall when the latch is in the mounted position;

wherein the inclination of the supporting first inclined surface with respect to the surface of the thin wall is selected such that developing play, between the first inclined surface and the rim or edge of the opening of the inner side of the thin wall, is compensated by movement induced by spring pressure on the supporting first inclined surface onto the rim or edge of the opening of the inner side of the thin wall, when the latch is in the mounted position;

wherein said free end of each of said holding elements is further provided with a second inclined surface for slam action, the second inclined surface being approximately at a right angle to the first inclined surface;

wherein said body part and holding elements are separate parts; and wherein said holding elements are slides of similar construction which are diametrically oppositely arranged so as to be displaceable in a cylinder of the body part that is parallel to the plane of the thin wall and is rectangular in cross section.

2. The latch according to claim 1;

wherein said slides are held against a pressure spring force of a spring by a hook arrangement locking between the slides or in the cylinder.

3. A latch for mounting in openings in a thin wall, comprising:

a head part which is to be arranged on one, outer side of the thin wall and which overlaps an outer rim of the opening;

a body part which proceeds from the head part and projects through the opening in the mounted position;

holding elements which project from the body part and are displaceable in direction of the holding elements' outer surfaces, a free end of said holding elements being provided with a first inclined surface for supporting the body part without play on the rim or edge of the opening of an other, inner side of the thin wall;

wherein the supporting first inclined surface is inclined with respect to the inner side of the thin wall, and rests on the rim or edge of the opening of the inner side of the thin wall when the latch is in the mounted position;

wherein the inclination of the supporting first inclined surface with respect to the surface of the thin wall is selected such that developing play, between the first inclined surface and the rim or edge of the opening of the inner side of the thin wall, is compensated by movement induced by spring pressure on the supporting first inclined surface onto the rim or edge of the opening of the inner side of the thin wall, when the latch is in the mounted position;

wherein said free end of each of said holding elements is further provided with a second inclined surface for slam action;

wherein said body part and holding element are two separate parts; and wherein said holding elements are slides comprising a rigid material which are arranged so as to be displaceable in a cylinder which is parallel to the plane of the thin wall, the slides being rectangular in cross section, and the slides being held against pressure spring force by a pin arrangement that is arranged between the slides, wherein the cylinder is formed of a body part having a rectangular cross-section, and wherein the slides are configured to be shiftable in the cylinder to have self-blocking functionality and provide a self-locking effect.

4. The latch according to claim 3;

wherein the pin arrangement comprises screws that can be screwed into the head part.

5. The latch according to claim 4;

wherein the screws determine the extent of the movement of the holding elements.

6. The latch according to claim 1;

wherein the cylinder has a partial dividing wall or undercut or opening edge at which the slides arc supported axially by a shoulder or hook.

* * * * *